US008109421B2

(12) United States Patent
McLean et al.

(10) Patent No.: US 8,109,421 B2
(45) Date of Patent: Feb. 7, 2012

(54) HANDS FREE CASE FOR MOBILE PERSONAL COMPUTERS

(76) Inventors: John Elliott McLean, Houston, TX (US); John Elliott McLean, Jr., Houston, TX (US)

( * ) Notice: Subject to any disclaimer, the term of this patent is extended or adjusted under 35 U.S.C. 154(b) by 882 days.

(21) Appl. No.: 12/217,540

(22) Filed: Jul. 8, 2008

(65) Prior Publication Data

US 2010/0006614 A1 Jan. 14, 2010

Related U.S. Application Data

(60) Provisional application No. 60/958,503, filed on Jul. 6, 2007.

(51) Int. Cl.

| | |
|---|---|
| ***A45F 3/02*** | (2006.01) |
| ***A45F 3/04*** | (2006.01) |
| ***B65D 85/00*** | (2006.01) |
| ***A45C 3/00*** | (2006.01) |

(52) U.S. Cl. ..... 224/270; 224/625; 224/626; 224/627; 224/655; 206/320; 190/100

(58) Field of Classification Search ..... 224/270, 224/607, 625, 626, 627, 644, 647, 655, 577, 224/575, 929, 930; 206/320; 190/100; D3/287, D3/900

See application file for complete search history.

(56) References Cited

U.S. PATENT DOCUMENTS

| | | | | | |
|---|---|---|---|---|---|
| 3,541,976 | A | | 11/1970 | Luis | |
| 4,062,469 | A | | 12/1977 | Rueb | |
| 4,715,293 | A | | 12/1987 | Cobbs | |
| 4,796,735 | A | * | 1/1989 | Horiuchi | 190/109 |
| 5,186,375 | A | * | 2/1993 | Plonk | 224/623 |
| 5,551,615 | A | * | 9/1996 | McIntosh | 224/270 |
| 5,639,004 | A | * | 6/1997 | Carlton et al. | 224/579 |
| 5,649,654 | A | * | 7/1997 | Hayward, Jr. | 224/270 |
| 5,667,114 | A | * | 9/1997 | Bourque | 224/270 |
| 5,682,993 | A | * | 11/1997 | Song | 206/320 |
| 5,724,225 | A | * | 3/1998 | Hrusoff et al. | 361/679.55 |
| 5,762,250 | A | * | 6/1998 | Carlton et al. | 224/579 |
| 5,816,460 | A | | 10/1998 | Cook | |
| D403,005 | S | | 12/1998 | Herman | |
| 5,845,833 | A | | 12/1998 | Murphy | |
| 5,850,956 | A | * | 12/1998 | Hayward, Jr. | 224/270 |
| 5,887,777 | A | * | 3/1999 | Myles et al. | 224/578 |
| 5,893,503 | A | | 4/1999 | Jean | |

(Continued)

OTHER PUBLICATIONS

Operator Holster, website, http://www.lazercad.co.uk/docs/cadpad-bundle.htm.

(Continued)

*Primary Examiner* — Justin Larson
*Assistant Examiner* — Lester L Vanterpool

(57) ABSTRACT

A hands free case for mobile personal computers provides a mobile worker a stable platform for laptops, Tablet PCs, Ultra Mobile PCs and accessories. One embodiment comprises a platform insert (22), fabric shell (24), shoulder harness (28), waist/torso harness(30) and an articulated flap (26). Shoulder harness (28) and waist/torso harness (30) is attached to fabric shell (24) via two or more rings and hooks allowing multiple configurations of straps and computer display orientations. Mobile personal computer is secured to platform insert (22) by impact-resistant cordage. When shoulder harness (28) and waist/torso harness (30) is placed around the body a mobile personal computer is carried without being held. The case can be positioned vertically along the body and tilted to improve viewing by adjusting the length of shoulder harness (28) and waist/torso harness (30). When articulated flap (26) is buckled to top of fabric shell (24) mobile personal computer is enclosed in a protective case.

4 Claims, 16 Drawing Sheets

U.S. PATENT DOCUMENTS

| | | | | |
|---|---|---|---|---|
| 5,908,147 | A * | 6/1999 | Chuang | 224/607 |
| 5,938,096 | A * | 8/1999 | Sauer et al. | 224/625 |
| 6,006,970 | A * | 12/1999 | Piatt | 224/257 |
| 6,041,924 | A | 3/2000 | Tajima | |
| 6,145,661 | A * | 11/2000 | Jung | 206/320 |
| 6,164,505 | A | 12/2000 | Holter | |
| 6,239,968 | B1 | 5/2001 | Kim et al. | |
| 6,273,252 | B1 | 8/2001 | Mitchell | |
| 6,273,310 | B1 * | 8/2001 | Gregory | 224/275 |
| 6,313,982 | B1 | 11/2001 | Hino | |
| 6,317,313 | B1 | 11/2001 | Mosgrove et al. | |
| 6,349,864 | B1 * | 2/2002 | Lee | 224/270 |
| 6,381,127 | B1 * | 4/2002 | Maddali et al. | 361/679.55 |
| 6,445,577 | B1 | 9/2002 | Madsen et al. | |
| 6,530,475 | B1 * | 3/2003 | Penney | 206/320 |
| 6,646,864 | B2 | 11/2003 | Richardson | |
| 7,051,910 | B2 * | 5/2006 | Sprague et al. | 224/638 |
| 7,191,926 | B1 * | 3/2007 | Costantino et al. | 224/605 |
| 7,327,562 | B2 | 2/2008 | Littlepage | |
| 7,778,026 | B2 * | 8/2010 | Mitchell | 361/679.55 |
| 7,780,049 | B1 * | 8/2010 | Baranoski | 224/250 |
| 2003/0029755 | A1 * | 2/2003 | Ho | 206/320 |
| 2005/0145528 | A1 * | 7/2005 | Matias et al. | 206/521 |
| 2006/0037987 | A1 * | 2/2006 | Lin | 224/646 |
| 2006/0113342 | A1 * | 6/2006 | Hampton et al. | 224/409 |
| 2007/0051766 | A1 * | 3/2007 | Spencer | 224/607 |
| 2007/0221696 | A1 * | 9/2007 | Kakita | 224/581 |
| 2007/0227923 | A1 * | 10/2007 | Kidakarn | 206/320 |

OTHER PUBLICATIONS

Hands Free Carrying Case for the g840XT, website, http://www.tabletkiosk.com/tkstore/pc/viewPrd.asp?idcategory=22&idproduct=265.

* cited by examiner

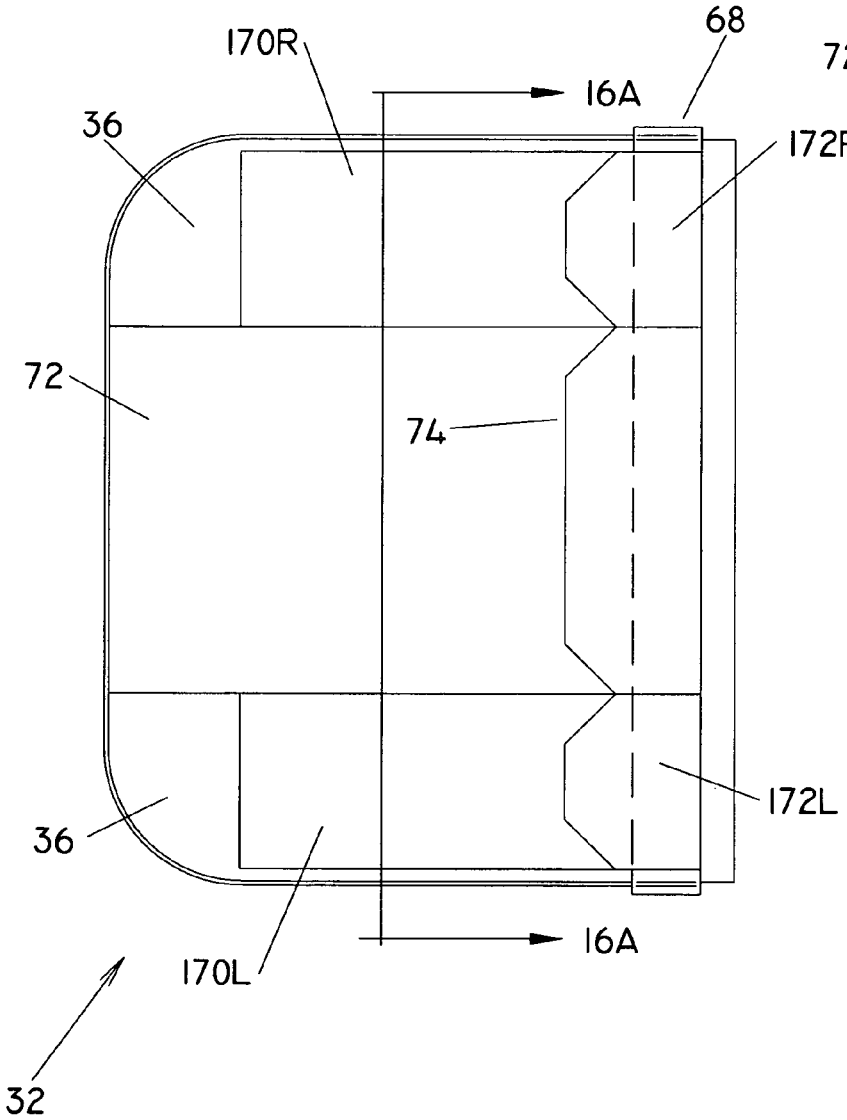
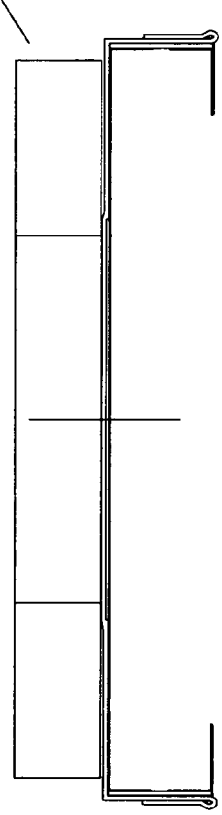
FIG. 16A
FIG. 16

HANDS FREE CASE FOR MOBILE PERSONAL COMPUTERS

CROSS-REFERENCE TO RELATED APPLICATIONS

This application claims the benefit of the provisional patent application Ser. No. 60/958,503, filed 2007 Jul. 6 by the inventors and is included by reference.

FEDERAL SPONSORED RESEARCH

Not Applicable

SEQUENCE LISTING OR PROGRAM

Not Applicable

BACKGROUND

1. Field

This application relates to carrying cases, specifically to cases for mobile personal computers.

2. Prior Art

Originally computer carrying cases where designed to just transport the portable computer and to carry accessories. To transport the portable computers the operator had to fasten the portable computer in to the carrying case with straps and dividers. These were to keep the portable computer from moving around in the carrying case. To use the computer once on location, the operator had to unfasten the straps and remove the computer from the case. Once the computer was removed from the case, the case no longer provided any protection for the computer and became another item to keep track of.

Therefore different types of computer carrying cases have been designed to increase utility of the computer carrying case, handle transporting and protectioning the portable computer.

A number of devices have been described in the art for portable desk tops or working platforms. U.S. Pat. No. 3,541,976 to Rozas (1970 Nov. 24) entitled "Portable Body-Mounted Desk" discloses a portable writing desktop or table that is supported by the wearer's body. A solid plate parallel to the torso of the wearer is fastened to the wearer using shoulder and belt straps. During a fall, any one the supports could break and be driven into the body of the wearer. This device did not envision the advent of mobile personal computers.

U.S. Pat. No. 4,715,293 to Cobbs (1987 Dec. 29) entitled "Body-Supported Hand-Operated Instrument Desk" discloses a rigid frame support for desktop or table which can be rotated from a perpendicular angle to the torso to an angle parallel to the torso. The device only allows the desktop to be positioned directly in front of the user and all the weight of the instrument is carried on the user'shoulders. Adjustment for the wearer is limited to the number and distance between adjustment holes in the rigid frame. When the wearer bends over the rigid frame can rotate away from the shoulders thus cause discomfort to the wearer. Even though the description envisioned being used by a laptop, the method of securing the instrument to the desktop would cover the some of the controls or screen of a Tablet PC or UMPC.

U.S. Pat. No. 5,724,225 to Hrusoffet al. (1998 Mar. 3) entitled "Laptop Computer Carrying Tray" discloses a device for supporting a laptop within a rigid platform or tray while allowing the wearer to move about. The entire weight of the laptop and rigid platform is conveyed to the neck of the user. For the wearer to gain access to keyboard or other input device on the laptop, the hand or hands must be placed inside of the harness supporting the platform to the torso. If the wearer were to trip, the hands of the wearer could become entangled in the straps of the device thus not being available to help prevent a fall. The laptop is directly secured to the top and bottom shells of the device and there is no evidence of shock absorbing device or method, thus not improving the impact resistence of the laptop. The disclosed device has no means of being prevented from rotating away for the torso when the wearer bends over. Two problems are introduced during this event. The first problem is the center of gravity of the wearer has changed, thus putting more strain on the lower back, and increasing the chance of falling over. The second problem with the rotation is when the wearer stands upright again the focus of the user has changed from the task being preformed to catching and repositioning the tray back into a comfortable position. Even though the description envisioned being used by a laptop, the method of securing the instrument to the desktop would cover part of the controls or screen of a Tablet PC or UMPC.

U.S. Pat. No. 5,639,004 Carlton et al. (1997 Jun. 17) entitled "Convertible Carrying Case and Work Platform For Small Electronic Devices" discloses a device for carrying a notebook or laptop computer while allowing the wearer to move about. This patent also suffers from the rotational problem of U.S. Pat. No. 5,724,225 describe previously. There is no method described in the patent for attaching the computer to the carrying case. In this situation if the wearer was to trip, stumble, or fall, the computer could drop out of the case and fall on a hard surface and become damaged. The device described also does not provide or envision any thermal management for bottom fans on the computer or location of exhaust ports. The edges around the top of the case will rub hand and wrist of the wearer when writing on a touch screen enabled Tablet PCs or UMPCs. The convertible top is required to be rolled up by the wearer to position the computer and case from the torso to improve the viewing angle. It appears from the disclosed device to have a complex to manufacturing process.

U.S. Pat. No. D403,005 to Herman (1998 Dec. 22) entitled "Computer Aided Drafting Portable Viewer" discloses a design for viewer of drawings. The device described in the patent does not anticipate a mobile personal computer. The device described in the patent is for the specific application for viewing computer aided design paper documents. There is no disclosure of the ergonomics for using the device for extended period of time.

Advantages

Thus several advantages of one or more aspects are to provide

Hands of the operator are free to facilitate movement and assist in maintaining balance while not being required to hold the mobile personal computer.

Harness configurations can prevent hands from being entangled in the harness during a fall event.

Screen page orientation can be facilitated by reconfiguring the straps of the case for landscape or portrait mode.

Simple design of the harness allows for easy adjustments of the case in both the vertical and horizontal positions about the operator's torso.

The belt buckle can be either on the left or right side of the operator.

The display of the mobile personal computer can be orientated perpendicular to or any vertical angle to the operator's torso to improve viewing and reduce glare.

The base of the mobile personal computer is moved away from the torso of the operator to provide for an easy viewing angle of the display when looking down.

Shoulder harness can be configured to allow unobstructed access to the touch screen for a left or right handed operator. This configuration enables easy access to the screen for writing with a stylus or touching controls displayed the screen with a digit.

Impact resistance of mobile personal computer is improved by using shock absorbing cordage and not requiring the use of any mechanical fasteners.

The case provides robust thermal management for the faster and hotter mobile personal computers by allowing more air to flow around and under the computer when operating in the case. Exhaust ports along the side of the mobile personal computers are accommodated by the side bump rails.

Different hardware buttons and input/output port configurations can be easily accommodated by altering the location of slots or holes in the side bump rails and proper alignment of the shock cordage.

Case provides increased utility. This case can also function as a protective carrying case only requiring that the integrated cover be closed and fastened to the case.

Demand persists for an improved computer carrying cases for mobile personal computers. Demand for a computer carrying case to provided improved protection, increased utility, thermal management when operating and to fit smaller form factors.

These and other advantages of one or more aspects will become apparent from a consideration of the ensuing description and accompanying drawings.

SUMMARY

In accordance with one embodiment a computer carrying case consists of an interior support frame, exterior shell, belt and shoulder strap with an articulated cover. This embodiment assists a user to move about with a portable computer so the computer screen is always viewable without requiring the wearer to hold the portable computer.

DRAWINGS-FIGURES

In the drawings, closely related figures have the same numbers but different alphabetic suffixes.

FIG. 16 shows one embodiment of a multiple external pockets on back of case.

FIG. 16A shows cross section of embodiment of a multiple external pockets on back of case.

DRAWINGS-REFERENCE NUMERALS

Figure 1:
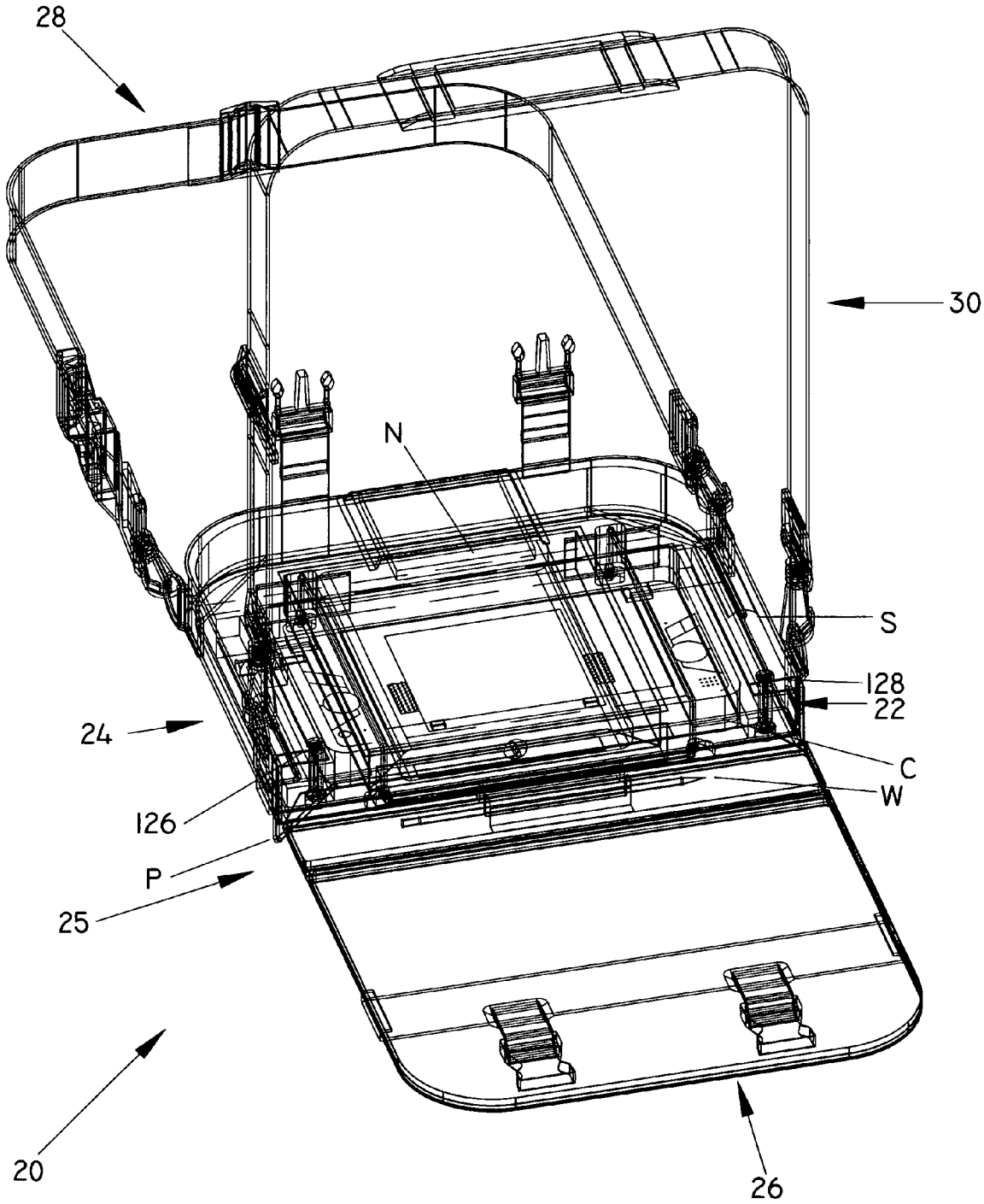
FIG. 1 shows the prospective view of the major components looking down at the top of the carrying case.

20 hands free case for mobile personal computers
22 platform insert
24 fabric shell
25 top articulated flap
26 articulated flap
28 waist/torso harness
30 shoulder harness
32 exterior auxiliary pocket
34 vertical webbing of fabric shell
36 bottom base of fabric shell
38 top base of fabric shell
40 stylus holder
42 auxiliary note pad pocket with flexible opening
44 elastic for note pad pocket
46 lower edge restraining elastic
48 left conventional male buckle
50 left male buckle webbing
52 right conventional male buckle
54 right male buckle webbing
56 left rear conventional D-ring
58 left rear D-ring attachment webbing
60 right rear conventional D-ring
62 right rear D-ring attachment webbing
64 left top conventional D-ring
66 right top conventional D-ring
68 top D-ring attachment webbing
70 optically clear flexible sheet
72 external auxiliary pocket
74 external auxiliary flap
76 external auxiliary pocket conventional loop material
78 external auxiliary flap conventional hook material
80 ribbon for exterior carrying case
82 left conventional grommet
84 right conventional grommet
86 exterior fabric for articulated flap
88 interior fabric for articulated flap
89 interior fabric for writing instruments holder
90 thin plastic sheet for articulated flap
92 foam for articulated flap
94 thin plastic sheet for articulated flap top
96 foam for articulated flap top
98 left conventional female buckle
100 left female buckle webbing
102 right conventional female buckle
104 right female buckle webbing
106 wide webbing on flap
108 base cushion
110 base plate
111L left cordage locking slot
111R right cordage locking slot

112 top rear cushion
113L left rear hole
113R right rear hole
114 left cushion rail
115L left front hole
115R right front hole
116 right cushion rail
118 left conventional female-female standoff
120 right conventional female-female standoff
122 left conventional base plate screw
124 right conventional base plate screw
126 left conventional top rail screw
128 right conventional top rail screw
130 retaining elastic cordage
132 rear left overhand knot
134 front left overhand knot
136 front right overhand knot
138 rear right overhand knot
140 left vertical retaining cordage plate
142 right vertical retaining cordage plate
144 left adjustable thermal management pad
146 right adjustable thermal management pad
148 left waist/torso pivoting snap hook
150 waist/torso interconnect webbing
152 waist/torso buckle male
153 waist/torso buckle female
154 waist/torso adjustment slide
156 waist/torso webbing
158 right waist/torso pivoting snap hook
160 left shoulder pivoting snap hook
162 shoulder harness webbing
164 shoulder adjustment slide
166 shoulder pad
168 right shoulder pivoting snap hook
170L left external auxiliary pocket
170R right external auxiliary pocket
172L left external auxiliary flap
172R right external auxiliary flap
174L left external auxiliary pocket conventional loop material
174R right external auxiliary pocket conventional loop material
176L left external auxiliary pocket conventional hook material
176R right external auxiliary pocket conventional hook material
B external battery pack
C mobile personal computer
D top of desk
N note pad
O operator
P power cable
S stylus for touch or pen enabled screen
W writing instrument Notation and Nomenclature Certain terms are used throughout the following descriptions and claims to refer to particular system components. This document does not intend to distinguish between components that differ in name but not function.

Page orientation is the way in which a rectangular page is oriented for normal viewing. The typical orientation is either landscape or portrait mode. Portrait orientation is where the height of the page is greater than the width, and is more common for the pages of books. Landscape orientation, where the width of the page is greater than the height, is often used for images and diagrams that need to be wider than a portrait page.

Computer displays or screens are also described using the term of page orientation. Typically the computer screen is oriented in landscape. With some of the newer computers portrait mode is also available.

Mobile computers or portable computers are any embodiments of computer system that consist of an operating system, central processing unit and memory, flat computer screen, have some type of permanent data storage and can be powered by a battery for an extended period of time which is rechargeable. Input devices for these computers may consist of an attached keyboard or a touch sensitive screen. Mobile computers are composed of various form factors and configurations.

Laptop computers are a mobile computers that contain a flat LCD screen, keyboard with a pointing device and maybe powered by a battery or AC power. Laptops weigh between 5 and 7 pounds (2.3 and 3.2 kg) with a screen size of 14.1 or 15.4 inches (35 or 39 cm) diagonally. In some cases, older models can weigh up to 15 pounds. The typical outside dimensions for this form factor are length of 12.5 inches (31.7 cm), width of 9.5 to 11 inches (24.1 cm to 28 cm) and depth of 1 to 1.5 inches (2.5 to 3.8 cm). The screen displays a laptop is landscape. Portrait mode is not available since the keyboard and screen need to be oriented the in the same direction.

Tablet PC computers are also called notebooks or slate portable computers. The slate resembles a clip board or writing slate. The slate is without a dedicated keyboard. Its touchscreen or graphics tablet/screen hybrid technology allows the user to operate the computer with a stylus or digital pen, or a fingertip, instead of a keyboard or mouse and maybe powered by a battery or AC power. These tablet PCs typically incorporate a flat LCD screen size of 8.4 to 14.1 inches (21 to 36 cm) diagonally. The units weigh between 2.5 and 5 pounds (1 and 2 kg). The slate form factor has a subcategory that is called a convertible. The only difference is that has an attached keyboard that can be folded behind the LCD screen to now resemble a slate. The typical outside dimensions for this form factor are length of 11.5 inches (29.2 cm), width of 8 to 8.5 inches (20.3 cm to 21.6 cm) and depth of 1 to 1.2 inches (2.5 to 3 cm). The slate can have the screen in either landscape or portrait depending on the how the system is configured.

Ultra Mobile PC Computer is also called hand held or UMPCs. The UMPC is a smaller form factor of the slate and is a little bigger than 8×5 note card. The UMPC may or may not have a dedicated keyboard. Its touchscreen or graphics tablet/screen hybrid technology allows the user to operate the computer with a stylus or digital pen, or a fingertip, instead of a keyboard or mouse and may be powered by a battery or AC power. The UMPC typically incorporates a flat LCD screen size of 5.0 to 8.0 inches (12.7 to 20.3 cm) diagonally. The units weigh typically less than 2.5 pounds (1 kg). The typical outside dimensions for this form factor is length of 9.5 inches (24.1 cm), width of 4.5 to 5.5 inches (11.4 cm to 14 cm) and depth of 1 to 1.2 inches (2.5 to 3 cm). The UMPC can have the screen in either landscape or portrait depending on the how the system is configured.

In following discussions and claims, the term "fabric" is used in open-ended fashion. When describing various embodiments, "fabric" is used as a woven or non-woven fibrous materials which can contain natural or synthetic material or any combinations or mixtures of the two materials. This is not to preclude any embodiment which may use other materials which are not fibrous but flexible like a woven fabric. An example would be plastic vinyl or leather.

In following discussions and claims, the term "foam" is use in open-ended fashion. When describing various embodiments, "foam" is used as a lightweight form of plastic or rubber material that has been expanded using chemical agents to release a gas or entrap air bubbles within the form. This is not to preclude any embodiment which may use other materials that can act as a cushion and retain structural shape.

In following discussions and claims, the term "webbing" is used in open-ended fashion. When describing various embodiments "webbing" is a strong closely woven fabric used chiefly for making straps and belts. The two edges along the length of the material are finished and require no farther processing to be used. This is not to preclude any embodiment which may use other materials which are not fibrous but flexible like a woven fabric. An example would be plastic vinyl or leather.

In following discussions and claims, the term "adhere" is used in open-ended fashion. When describing various embodiments "adhere" means stick fast to using some type of adhesive, epoxy, chemical solvent or mechanical process to join two or more parts together. This is not to preclude any embodiment which may use heat to melt the surface of material before joining, melting glue to be applied to the surfaces to be joined or molding a foam over a plastic or metal part.

In following discussions and claims, the term "joined" is used in open-ended fashion. When describing various embodiments, "joined" means that two or more parts are fastened by mechanical or chemical methods or processes. This is not to preclude any embodiment which may use stitching, gluing, welding, bolting, screwing or riveting.

DETAILED DESCRIPTION

First Embodiment—FIGS. 1, 2, 3, 3A, 3B, 4, 5, 6, 7

Figures 3, 3A, 3B:
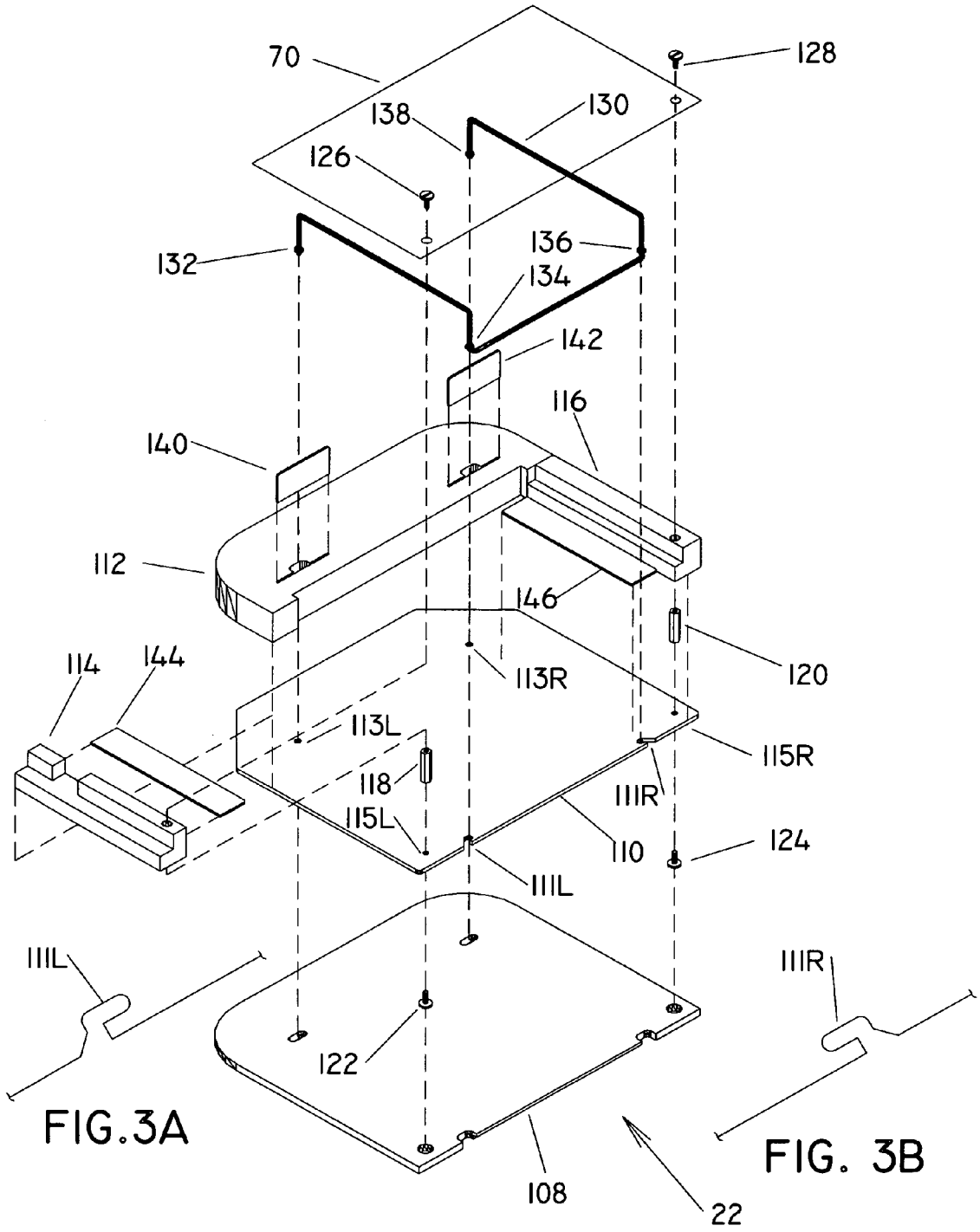
FIG. 3 shows an exploded prospective view of the interior desktop insert of the case.
FIG. 3A shows the left cordage locking slot in plan.
FIG. 3B shows the right cordage locking slot in plan.
Figure 4:
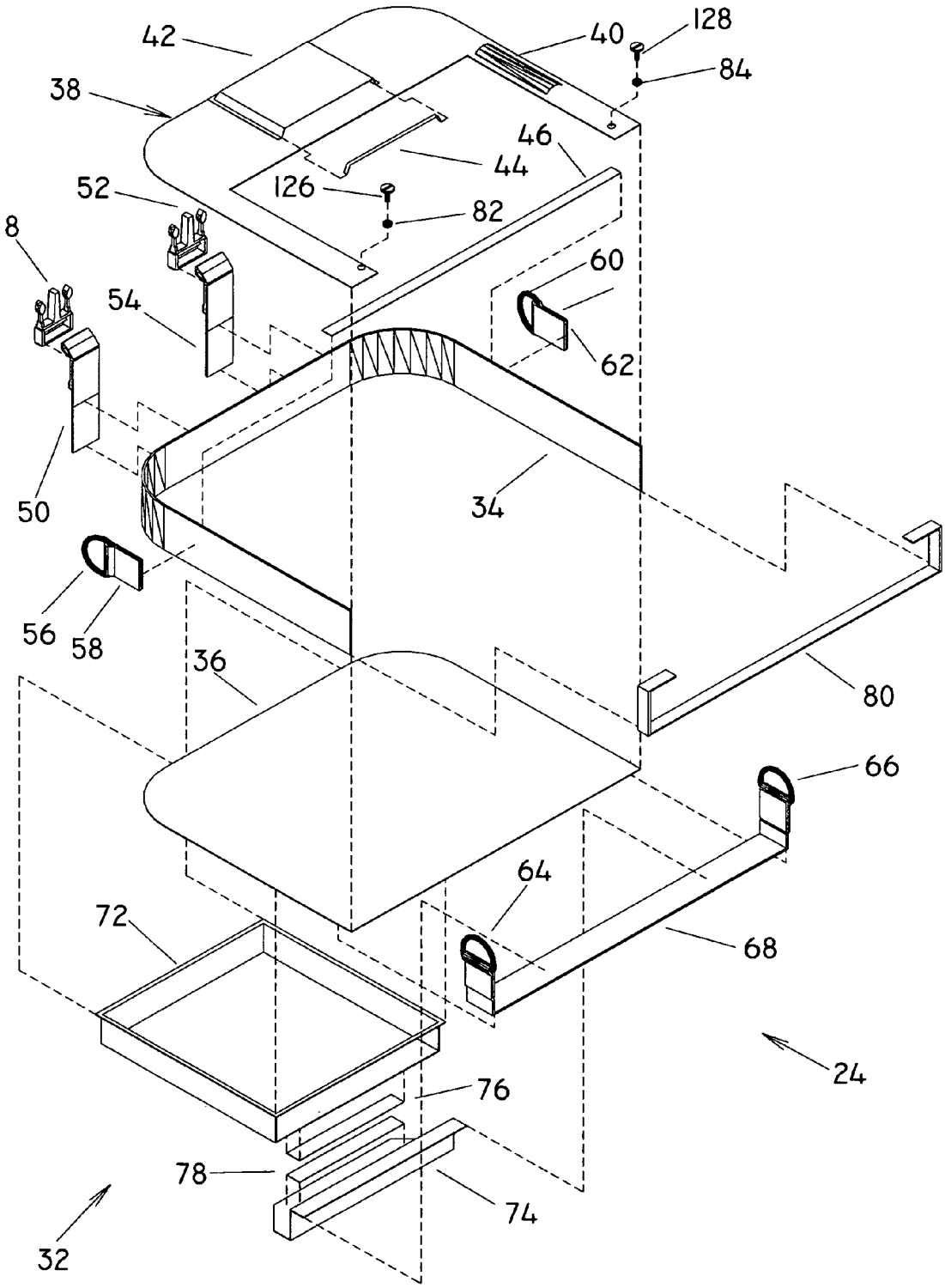
FIG. 4 shows an exploded prospective view of the exterior of the fabric shell of the case.

FIG. 1 illustrates an embodiment of the hands free case for mobile computers 20 overall prospective view from above and to the right. The platform insert 22 (FIG. 3) is attached to the fabric shell 24 (FIG. 4) using the left conventional screw 126 (FIG. 3) and the right conventional screw 128 (FIG. 3). The articulated flap 26 (FIG. 5) is fastened to the bottom of fabric shell 24. The waist harness 28 (FIG. 6) is attached to fabric shell 24 using the left conventional D-ring 56 (FIG. 4) and the right conventional D-ring 60 (FIG. 4). The shoulder harness 30 (FIG. 7) is attached to fabric shell 24 using the left conventional D-ring 64 (FIG. 4) and the right conventional D-ring 66 (FIG. 4).

Figure 2:
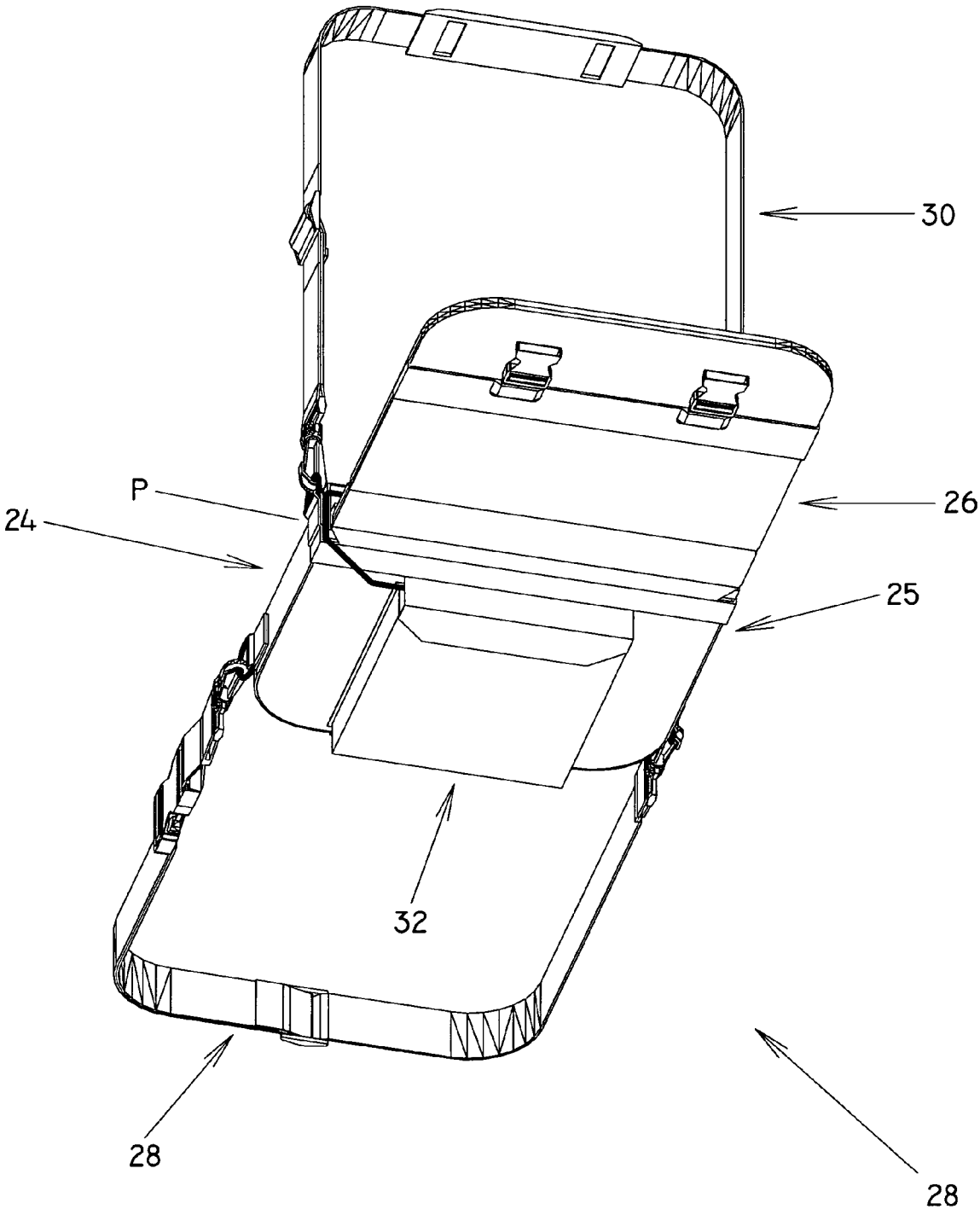
FIG. 2 shows the prospective view of the major components looking up at the bottom of the carrying case.

FIG. 2 of this embodiment of illustrates a prospective view from the bottom and to the right. The view shows the auxiliary external pocket 32 (FIG. 4) which is fastened to fabric shell 24. The power cable P for the external battery pack B (which is not shown) routed from the exterior auxiliary pocket 72 (FIG. 4) to left corner of the fabric shell 24 and up to the channel in the left cushion rail 114 (FIG. 3) and under the top base of fabric shell 38 (FIG. 4) and plugged into the power input port of mobile personal computer C (FIG. 1).

FIG. 3 of this embodiment illustrates an exploded view of platform insert 22 viewed from the top looking down and from the right.

Rear left and rear right corners of base plate 110 are cut at a 45 degree angle to the left and right edges of base plate 110. The starting location of the corners are half (½) distance between the front of the top rear cushion 112 the start of the circular arc of the top rear cushion 112.

The left rear hole 113L is positioned 2.5 centimeters (1 inch) from the front of top rear cushion 112. The right rear hole 113R is positioned 2.5 centimeters (1 inch) from the front of top rear cushion 112.

Left rear hole 113L and the right end of left cordage locking slot 111L are position from the left edge of base plate 110 so left side of retaining elastic cordage 130 is aligned not to cross over the screen or controls of mobile personal computer C. Right rear hole 113R and the left end of right cordage locking slot 111R are position from the right edge of base plate 110 so the right side of retaining elastic cordage 130 is aligned not to cross over the screen or controls of mobile personal computer C. The alignment of retaining elastic cordage 130 will vary for each mobile personal computer C since the layout of screen and controls vary.

The center of the left front hole 115L is located half the width of the left cushion rail 114 and 1-½ diameters of the left conventional female-female standoff 118. The center of the right front hole 115R is located half the width of the right cushion rail 116 and 1½ diameters of the right conventional female-female standoff 120.

Left conventional female-female standoff 118 is fastened to base plate 110 with the left conventional base plate screw 122 being inserted from the bottom through the left front hole 115L. Right conventional female-female standoff 120 is fastened to base plate 110 with the right conventional base plate screw 124 being inserted from the bottom through right front hole 115R.

The base cushion 108 is formed out of a foam. The overall dimension of base cushion 108 match those of base plate 110. Holes and slots need to be formed in base cushion 108 to match the above holes and slots in base plate 110. In this embodiment the rear left corner of base cushion 108 is to be rounded to a quarter circle having a radius of 5 centimeters (2 inches). The rear right corner of base cushion 108 is to be rounded to a quarter circle having a radius of 5 centimeters (2 inches).

The top rear cushion 112 is formed out of a foam. The overall width dimension of top rear cushion 112 match the width of base plate 110.

Holes and/or slots need to be formed in top rear cushion 112 to match the location of left rear hole 113L and right rear hole 113R in base plate 110. Make a full depth slit in front of the hole which matches left rear hole 113L. The length of this slit should match the length of the left vertical retaining cordage plate 140. Make a full depth slit in front of the hole which matches right rear hole 113R. The length of this slit should match the length of the right vertical retaining cordage plate 142.

In this embodiment, the rear left corner of top rear cushion 112 is to be rounded to a quarter circle having a radius of 5 centimeters (2 inches). The rear right corner of top rear cushion 112 is to be rounded to a quarter circle having a radius of 5 centimeters (2 inches).

In this embodiment, left cushion rail 114 has a square section. The length of left cushion rail 114 is from the front of base plate 110 to the front of top rear cushion 112. Notch upper left quadrant of left cushion rail 114 for the entire length. Notch the rear end of left cushion rail 114 to a size to facilitate inserting and removing the power cable P's plug from mobile personal computer C's power port.

Place a hole perpendicular to base plate 110 in left cushion rail 114 equal to the diameter of left conventional female-female standoff 118. The above hole location should match left front hole 115L when left cushion rail 114 is installed.

In this embodiment right cushion rail 116 has a square cross section. The length of right cushion rail 116 is from the front of base plate 110 to the front of top rear cushion 112. Notch upper left quadrant of right cushion rail 116 for the entire length.

Place a hole perpendicular to base plate 110 in right cushion rail 116 equal to the diameter of right conventional female-female standoff 120. The hole location should match right front hole 115R when right cushion rail 116 is installed.

Align edges of base cushion 108 with edges of base plate 110. Adhere base cushion 108 to the base plate 110.

Align left, right and rear edges of top rear cushion 112 with left, right and rear edges of base plate 110. Adhere top rear cushion 112 to top of base plate 110.

Adhere any portions of base cushion 108 and top rear cushion 112 to each other where base plate 110 is not present.

Slip left cushion rail 114 over left conventional standoff female-female standoff 118. Adhere bottom and back end of left cushion rail 114 to left side of base plate 110 and left front end of top rear cushion 112. Slip right cushion rail 116 over right conventional female-female standoff 120. Adhere bottom and back end of the right cushion rail 116 to right side of base plate 110 and to right front end of top rear cushion 112.

The left adjustable thermal management pad 144 is positioned horizontally on base plate 110 to be centered on the left side bottom feet of the mobile personal computer and the position marked. The vertical height of a left adjustable thermal management pad 144 is to be two times or greater then the vertical clearance between a flat surface and the bottom of a mobile personal computer C. Then adhere left adjustable thermal management pad 144 to the previously marked location on base plate 110.

The right adjustable thermal management pad 146 is positioned horizontally on base plate 110 to be centered on the right side bottom feet of the mobile personal computer and the position marked. The vertical height of a right adjustable thermal management pad 146 is to be two times or greater then the vertical clearance between a flat surface and the bottom of a mobile personal computer C. Then join right adjustable thermal management pad 146 to the previously marked location on base plate 110.

Insert left vertical retaining cordage plate 140 into left slit in top rear cushion 112 and push down to base plate 110. Insert right vertical retaining cordage plate 142 into right slit in top rear cushion 112 and push down to base plate 110.

The retaining elastic cordage 130 is tied on one end using the overhand knot 132. Overhand knot 132 is located 6 mm to 10 mm (0.25 to 0.375 inches) from one end of retaining elastic cordage 130. Thread the opposite end through the left rear hole of the base cushion 108 up through the left rear hole in the base plate 110 through the left rear hole in the top rear cushion 112. Loop retaining elastic cordage 130 over left vertical retaining cordage plate 140. Position retaining elastic cordage 130 at the opening of left cordage locking slot 111L and pull down and to the right to set that retaining elastic cordage 130 into left cordage locking slot 111L. Pull down on retaining elastic cordage 130 and tie an overhand knot 134, so that retaining elastic cordage 130 is under tension when overhand knot 134 is positioned below the right end of left cordage locking slot 111L. Pull retaining elastic cordage 130 to the right and then tie the overhand knot 136 so enough of retaining elastic cordage 130 this segment is under tension when finished. Position retaining elastic cordage 130 at the opening of right cordage locking slot 111R and pull up and to the left to set that retaining elastic cordage 130 into right cordage locking slot 111R. Overhand knot 136 should be under right cordage locking slot 111R and retaining elastic cordage 130 is pulled through the hole in right cordage locking slot 111R. Loop retaining elastic cordage 130 over right vertical retaining cordage plate 142 and thread the free end of retaining elastic cordage 130 through right rear hole in the top rear cushion material, through the right rear hole in the base plate 110 and through the right rear hole of the base cushion 108 and pull the retaining elastic cordage 130 out enough to tie the overhand knot 138 so when retaining elastic cordage 130 is released the overhand knot 138 is against base plate 110. Retaining elastic cordage 130 should be under tension between overhand knot 136 when positioned below and at the left end of right cordage locking slot 111R and overhand knot 138. The end of retaining elastic cordage 130 is located 6 mm to 10 mm (0.25 to 0.375 inches) from overhand knot 132.

The optically clear flexible sheet 70 is laid over the left cushion rail 114, top rear cushion 112, retaining elastic cordage 130 and right cushion rail 116. Position the left hole in optically clear flexible sheet 70 over conventional female-female standoff 118. Position the right hole in optically clear flexible sheet 70 over conventional female-female standoff 120. Insert the left conventional top rail screw 126 through the left front hole in optically clear flexible sheet 70 and screw into conventional female-female standoff 118. Insert the right conventional top rail screw 128 through the right front hole in optically clear flexible sheet 70 and screw into conventional female-female standoff 120.

FIG. 3A of this embodiment illustrates a plan view of the detailed geometry of the left cordage locking slot 111L. The width of left cordage locking slot 111L should be bigger than the diameter of retaining elastic cordage 130. Right end of left cordage locking slot 111L needs to be aligned with left rear hole of base plate 110 so retaining elastic cordage 130 does not cross mobile personal computer C (FIG. 1) display screen.

FIG. 3B of this embodiment illustrates a plan view of the detailed geometry of the right cordage locking slot 111R. The width of right cordage locking slot 111R should be bigger than the diameter of retaining elastic cordage 130. Left end of right cordage locking slot 111R needs to be aligned with right rear hole of base plate 110 so retaining elastic cordage 130 does not cross mobile personal computer C (FIG. 1) display screen.

FIG. 4 of this embodiment of illustrates an exploded view of fabric shell 24 according this embodiment. The bottom base of fabric shell 36 is joined to the inside of and flush with the bottom edge of the vertical webbing of fabric shell 34.

The interior edges of the opening in top base of fabric shell 38 seam is joined to the underside of top base of fabric shell 38 leaving the left and right ends of the open side seam open. The fabric stylus holder 40 is joined to top base of fabric shell 38 leaving the top and bottom ends open. The auxiliary note pocket with flexible opening 42 left, bottom and right seams are folded and joined unto itself closing all ends. The top seam of auxiliary note pocket with flexible opening 42 is joined unto itself leaving the left and right ends open. The elastic for auxiliary note pad pocket 44 is threaded through the top seam of auxiliary note pocket with flexible opening 42. The completed auxiliary note pocket with flexible opening 42 and elastic for auxiliary note pad pocket 44 left and right ends being joined to the middle and outside the seam of the top base of fabric shell 38. Top base of fabric shell 38 outside seam is joined to the inside of and flush with the top edge of the vertical webbing of fabric shell 34.

The left rear D-ring attachment webbing 58 is threaded through the left rear conventional D-ring 56 and looped back on itself so that the flat portion left rear D-ring 56 is enclosed by the material. The left rear D-ring attachment webbing 58 is located on left side, centered between the edges, with arch of the d-ring pointed to the rear of the case and joined to vertical webbing of fabric shell 34 (FIG. 4). The right rear D-ring attachment webbing 62 is threaded through the right bottom rear D-ring 60 and looped back on itself so that the flat portion right rear D-ring 60 is enclosed by the material. The right rear D-ring attachment webbing 62 is located on right side, centered between the edges, with arch of the D-ring pointed to the rear of the case and joined to vertical webbing of fabric shell 34 (FIG. 4).

One end of the left male buckle webbing 50 is folded back onto itself and then folded second time unto itself and then the folds and the long piece are joined together. The end of left male buckle webbing 50 is threaded through the front slot of the left conventional male buckle 48 from the bottom side so that the folded webbing of left male buckle webbing 50 is facing the top base of fabric shell 38. Bend the end of the left male buckle webbing 50 down through the second slot of left conventional male buckle 48 and pull back under the folded end of the left male buckle webbing 50. Join the non folded end of left male buckle webbing 50 to vertical webbing of fabric shell 34 so that left male buckle webbing 50 is perpendicular to vertical webbing of fabric shell 34 and inside edge of Left male buckle webbing 50 lines up outside of the left edge of auxiliary note pocket with flexible opening 42 (FIG. 4).

One end of the right male buckle webbing 54 is folded back onto itself and then folded second time unto itself and then the folds and the long piece are joined together. The end of right male buckle webbing 54 is threaded through the front slot of the right conventional male buckle 52 from the bottom side so that the folded webbing of right male buckle webbing 54 is facing the top base of fabric shell 38. Bend the end of the right male buckle webbing 54 down through second slot of right conventional male buckle 52 and pull back under a folded end of the right male buckle webbing 54. Join the non-folded end of right male buckle webbing 54 to vertical webbing of fabric shell 34 so that right male buckle webbing 54 is perpendicular to vertical webbing of fabric shell 34 and inside edge of right male buckle webbing 54 lines up outside of the right edge of auxiliary note pocket with flexible opening 42 (FIG. 4).

The external auxiliary pocket conventional loop material 76 length is ⅔ the finished width of external auxiliary pocket 72. External auxiliary pocket conventional loop material 76 is joined below the top seam and on the exterior of external auxiliary pocket 72.

The external auxiliary pocket conventional hook material 78 length equal to the length external auxiliary pocket conventional loop material 76. External auxiliary pocket conventional hook material 78 is joined below the top seam and on the interior of external auxiliary flap 74.

External auxiliary pocket 72 front seam is folded under and joined to the interior of external auxiliary pocket 72. The external auxiliary pocket conventional loop material 76 is centered along the top edge of external auxiliary pocket 72 and joined to the exterior of external auxiliary pocket 72. The left, rear and right seams are joined to the interior of external auxiliary pocket 72 and then are turned up perpendicular to external auxiliary pocket 72. The left rear vertical seams of external auxiliary pocket 72 are joined together to form the depth of the pocket. The right rear vertical seams of eternal auxiliary pocket 72 are joined together to form the depth of the pocket. Rear horizontal seam of external auxiliary pocket 72 is positioned on the exterior of bottom base of fabric shell 36 next to vertical webbing of fabric shell 34 along the centerline of bottom base of fabric shell 36. Left, rear and right seams of external auxiliary pocket 72 are joined to bottom base of fabric shell 36.

The external auxiliary flap 74 left, rear and right seams are joined to the interior of external auxiliary flap 74. The external auxiliary flap conventional hook material 78 is centered along the rear edge of external auxiliary flap 74 and joined to the interior of external auxiliary flap 74. External auxiliary flap 74 is centered along width of bottom base of fabric shell 36 and will be under the top D-rings attachment webbing 68. External auxiliary flap 74 top edge is joined to bottom base of fabric shell 36 to length which is equal to half the width of D-rings attachment webbing 68.

The rear edge of articulated flap 26 (FIG. 5) is positioned next to the top edge of external auxiliary flap 74 and center along width of bottom base of fabric shell 36. Interior of articulated flap 26 should be placed next to the exterior of bottom base of fabric shell 36 and then joined to bottom base of fabric shell 36.

The top D-ring attachment webbing 68 length is centered between the left and right edges of vertical webbing of fabric shell 34 and width of top D-rings attachment webbing 68 is centered along the rear edge of articulated flap 26 and joined to bottom base of fabric shell 36. The left end of top D-ring attachment webbing 68 is threaded through the left top conventional D-ring 64 from the outside to inside and looped back on itself so that the flat portion left top conventional D-ring 64 is enclosed by the webbing material and the left top conventional D-ring 64 is positioned level with top of vertical webbing of fabric shell 34. Folded left end of top D-ring attachment webbing 68 is stitched to vertical webbing of fabric shell 34. The right end of top D-ring attachment webbing 68 is threaded through the right top conventional D-ring 66 from the outside to inside and looped back on itself so that the flat portion right top conventional D-ring 66 is enclosed by the webbing material and the right top conventional D-ring 66 is positioned level with top of vertical webbing of fabric shell 34. Folded right end of top D-ring attachment webbing 68 is joined to vertical webbing of fabric shell 34.

The ribbon for exterior carrying case 80 is folded in half and joined to the open end of fabric shell 24. Ribbon for exterior carrying case 80 is joined from the left side top edge of the top base of fabric shell 38, down the left top end of vertical webbing of fabric shell 34, across the top edge of bottom base of fabric shell 36, up the right top end vertical webbing of fabric shell 34 and over to the right side top edge of top base of fabric shell 38.

The lower edge restraining elastic 46 is cut to approximately 75% of the width between the left and right side finished seams of top base of fabric shell 38. Thread lower edge restraining elastic 46 through the bottom open side seam of top base of fabric shell 38. The left end of lower edge restraining elastic 46 is joined to left side seam between the top base of fabric shell 38 and vertical webbing of fabric shell 34. The right end of lower edge restraining elastic 46 is joined to right side seam between the top base of fabric shell 38 and vertical webbing of fabric shell 34.

The left conventional grommet 82 is punched through top base of fabric shell 38. Left conventional grommet 82 is aligned with the top screw hole of left conventional female-female standoff 118 (FIG. 3). The right conventional grommet 84 is punched through top base of fabric shell 38. Right conventional grommet 84 is aligned with top screw hole of right conventional female-female standoff 120 (FIG. 3).

Figure 5:
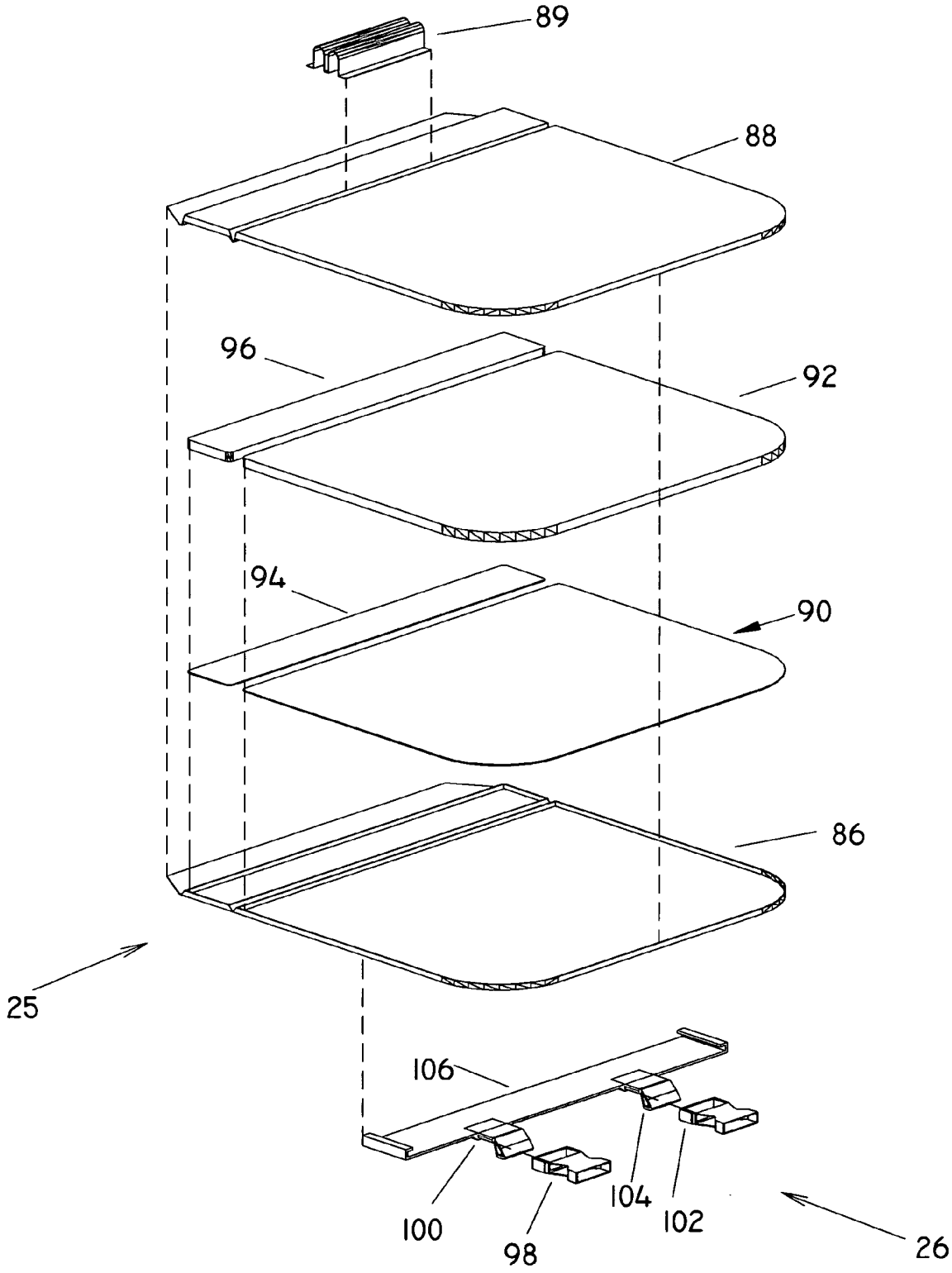
FIG. 5 shows an exploded prospective view of the exterior of the fabric and foam flap of the case.
Figure 13:
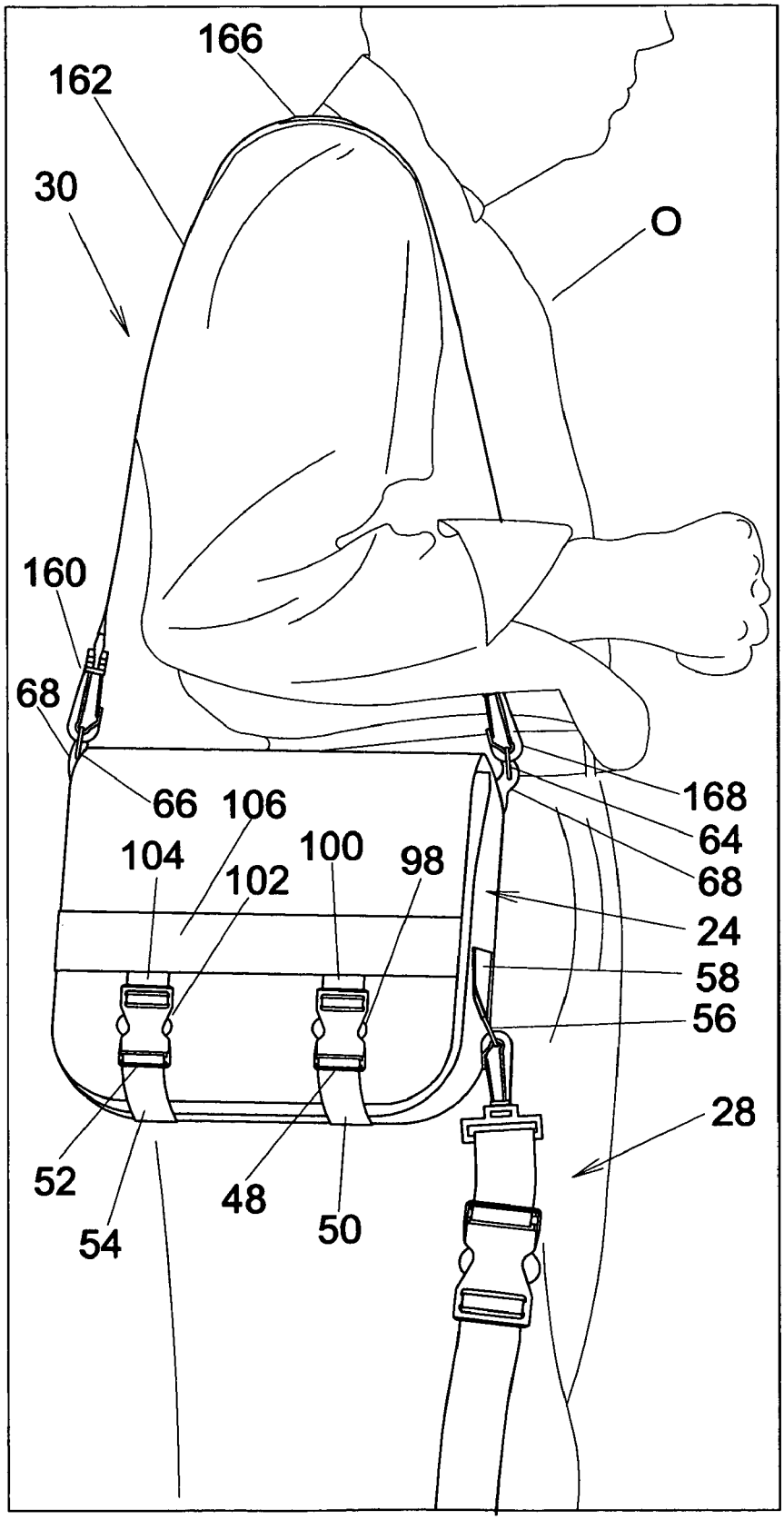
FIG. 13 shows one embodiment in two (2) point shoulder configuration.

FIG. 5 provides an exploded view of articulated flap 26 according to this embodiment. The left female buckle webbing 100 is threaded through end slot from the bottom of the left conventional female buckle 98 and threaded down through the next slot and pulled back to the other end of left female buckle webbing 100. Both ends of left female buckle webbing 100 should be aligned. The left female buckle webbing 100 and left conventional female buckle 98 are centered on left conventional male buckle 48 and leading edge of left conventional female buckle 98 far enough back for the front edge of articulated flap 26 to allow left conventional male buckle 48 insert into left conventional female buckle 98 and pull articulated flap 26 to rear edge of the fabric shell 24 (FIG. 13). Join left female buckle webbing 100 to the exterior fabric for articulated flap 86.

The right female buckle webbing 104 is threaded through end slot from the bottom of the right conventional female buckle 102 and threaded down through the next slot and pulled back to the other end of right female buckle webbing 104. Both ends of right female buckle webbing 104 should be aligned. The right female buckle webbing 104 and right conventional female buckle 102 are centered on right conventional male buckle 52 and leading edge of right conventional female buckle 102 far enough back for the front edge of articulated flap 26 to allow right conventional male buckle 52 insert into right conventional female buckle 102 and pull exterior articulated flap 26 to rear edge of the fabric shell 24 (FIG. 13). Join left female buckle webbing 104 to the exterior fabric for articulated flap 86.

The wide webbing on flap 106 is centered between the finished seams of exterior fabric for articulated flap 86 and directly at the rear of left conventional female buckle 98 and right conventional female buckle 102. Join wide webbing on flap 106 along edges to exterior fabric for articulated flap 86.

The interior fabric for articulated flap 88 exterior side if laced down over fabric for articulated flap 86 matching up the seams. Join interior fabric for articulated flap 88, fabric for articulated flap 86 seams together along with wide webbing on flap 106.

Turn the assembled interior fabric for articulated flap 88 and exterior fabric for articulated flap 86 inside out so that the exterior fabrics surfaces and buckles are showing. The seams from interior fabric for articulated flap 88 and exterior fabric for articulated flap 86 should now be in the interior.

The thin plastic sheet for articulated flap 90 is inserted between interior fabric for articulated flap 88 and exterior fabric for articulated flap 86. The foam for articulated flap side 92 is inserted between interior fabric for articulated flap 88 and exterior fabric for articulated flap 86 and below thin plastic sheet for articulated flap 90. Join interior fabric for articulated flap 88 and exterior fabric for articulated flap 86 together parallel to the rear edge of the thin plastic sheet for articulated flap 90 and foam for articulated flap side 92.

The interior fabric for writing instruments holder 89 requires all sided to be joined to provided a finished edge on all sides. Center a long side of interior fabric for writing instruments holder 89 between the finished seams of interior fabric for articulated flap 88 and exterior fabric for articulated flap 86 and parallel to join line between top articulated flag 25 and exterior articulated flap 26. Join interior fabric for writing instruments holder 89 to interior fabric for articulated flap 88. Stitch the opposite end of interior fabric for writing instruments holder 89 at a distance equal to the width of top articulated flag 25. Equally distribute the rest of the interior fabric for writing instruments holder 89 between the two seams and join in the middle of articulated flap 26.

The thin plastic sheet for articulated flap top 94 is inserted between interior fabric for articulated flap 88 and exterior fabric for articulated flap 86 pushed against the join line between top articulated flag 25 and articulated flap 26. The foam for articulated flap top 96 is inserted between interior fabric for articulated flap 88 and exterior fabric for articulated flap 86 and below thin plastic sheet for articulated flap top 94. Join interior fabric for articulated flap 88 and exterior fabric for articulated flap 86 together parallel to the rear edge of the thin plastic sheet for articulated flap top 94 and foam for articulated flap top 96.

Figure 6:
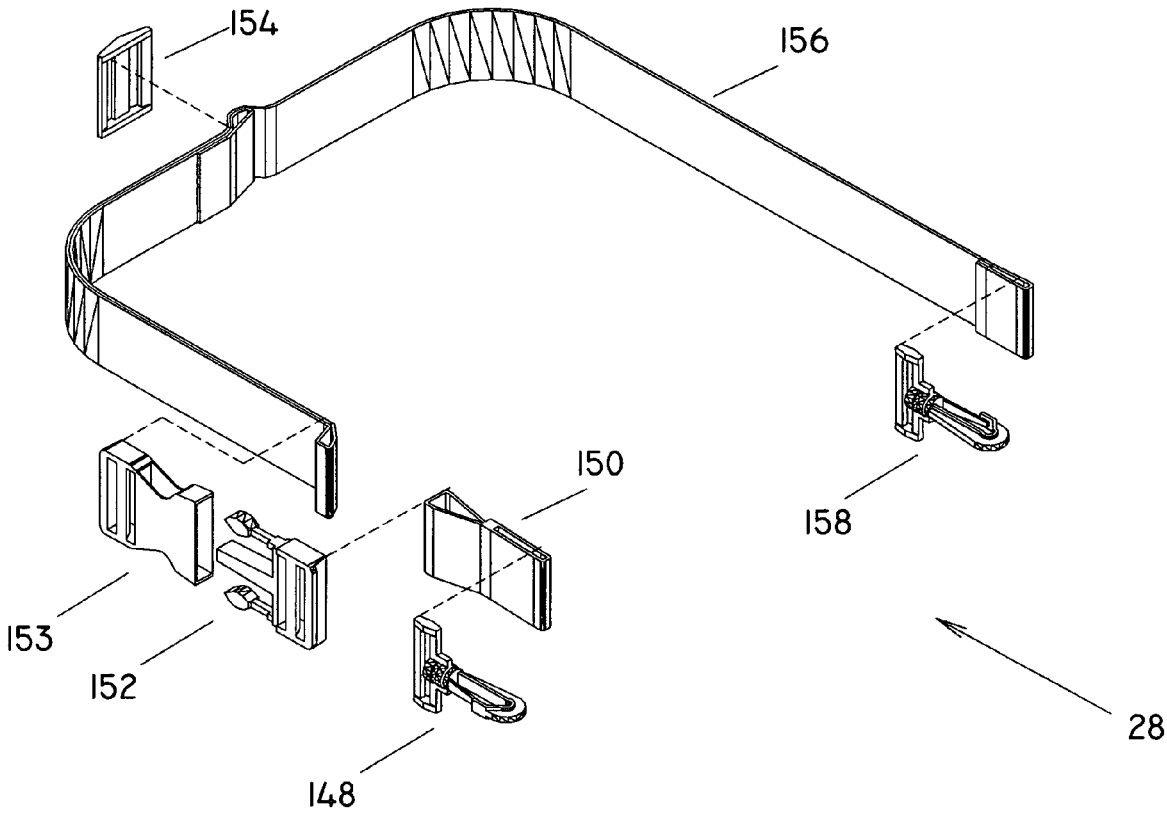
FIG. 6 shows an exploded view of the waist harness.

FIG. 6 provides an exploded view of waist/torso harness 28 according to this embodiment. The waist/torso interconnect webbing 150 is threaded through end slot of the waist/torso buckle male 152 from the front to the back and pulled to middle of waist/torso interconnect webbing 150. The other end of waist/torso interconnect webbing 150 is threaded through the end slot of the left waist/torso pivoting snap hook 148 slot and pulled to the middle of the waist/torso interconnect webbing 150 and fold back on itself with the fold being made toward waist/torso interconnect webbing 150 and pulled over to cover the opposite end of the webbing. Join the ends of waist/torso interconnect webbing 150 to the other side of the waist/torso interconnect webbing 150. The finished dimension of the waist/torso interconnect webbing 150 should between 5.5 and 7.5 cm (2.1 and 2.9 inches).

The waist/torso webbing 156 is threaded through and around the middle post the waist/torso adjustment slide 154 and pulled back over waist/torso webbing 156. Fold waist/torso webbing 156 back on itself with the fold being made toward Waist/torso webbing 156 and stitch the folded material to other side of the webbing.

Thread the free end of waist/torso webbing 156 through the inside slot of the waist/torso buckle female 153 from the back and loop over and pull down through the end slot of waist/torso buckle female 153. Thread the free end of waist/torso webbing 156 through the slot of waist/torso adjustment slide 154 closest to waist/torso buckle female 153. Thread waist/torso webbing 156 over the middle post and join the end of the webbing and thread through other slot of waist/torso adjustment slide 154.

Thread the free end of waist/torso webbing 156 through the slot of the right waist/torso pivoting snap hook 158 and pulled back over waist/torso webbing 156. Fold waist/torso webbing 156 back on itself with the fold being made toward waist/torso webbing 156 and join the folded material to other side of waist/torso webbing 156.

Figure 7:
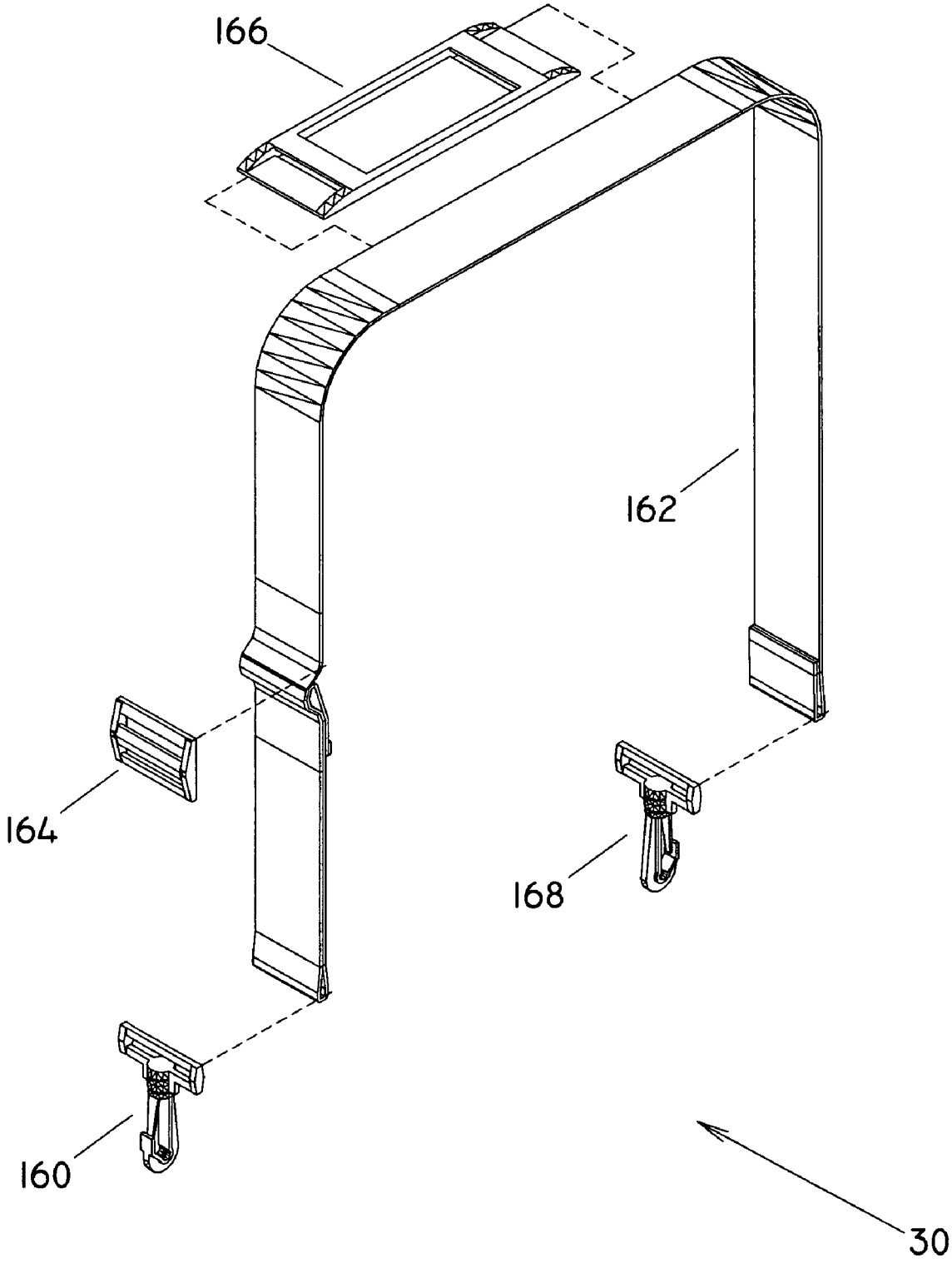
FIG. 7 shows an explode view of the shoulder harness.

FIG. 7 provides an exploded view of shoulder harness 30 according to this embodiment. The shoulder harness webbing 162 is threaded through and around the middle post the shoulder adjustment slide 164 and pulled back over shoulder harness webbing 162. Fold shoulder harness webbing 162 back on itself with the fold being made toward shoulder harness webbing 162 and join the folded material to other side of the webbing.

Thread the free end of shoulder harness webbing 162 through the slot of the left shoulder pivoting snap hook 160 and pulled back toward shoulder adjustment slide 164.

Thread the free end of shoulder harness webbing 162 through the slot of shoulder adjustment slide 164 closest to left shoulder pivoting snap hook 160. Thread shoulder harness webbing 162 over the middle post and join end of the webbing and thread through other slot of conventional webbing adjustment ring for shoulder harness (triglide) 164. Thread the free end of shoulder harness webbing 162 along the length of the shoulder pad 166 and below retaining straps.

Thread the free end of shoulder harness webbing 162 through the slot of the right shoulder pivoting snap hook 168 and pulled back over shoulder harness webbing 162. Fold shoulder harness webbing 162 back on itself with the fold being made toward shoulder harness webbing 162 and stitch the folded material to other side of the webbing.

Operation

First Embodiment—FIGS. 1, 2, 8, 9, 10, 11, 12, 13, 14, 15

FIG. 1 illustrates mobile personal computer C being secured in the hands free case for mobile personal computer 20. For operator O to remove the mobile personal computer C, operator O needs to release retaining elastic cordage 130. First operator O grasps front left overhand knot 134 below base plate 110 and pulling down and to the left to remove retaining elastic cordage 130 from left cordage locking slot 111L. Next operator O, grasps the front right overhand knot 136 below base plate 110 and pull down and to the right to remove retaining elastic cordage 130 from right cordage locking slot 111R.

With the retaining elastic cordage 130 free, operator O places mobile personal computer C unto the left adjustable thermal management pad 144 and right adjustable thermal management pad 146 and pushes mobile personal computer C all the way back against top rear cushion 112. To secure mobile personal computer C hands free case for mobile personal computer 20, operator O grasps front left overhand knot 134 and pull retaining elastic cordage 130 across the top and down the front side of mobile personal computer C until front left overhand knot 134 is below base plate 110. Place retaining elastic cordage 130 into left cordage locking slot 111L and pull retaining elastic cordage 130 to the right until the end of left cordage locking slot 111L is encountered. Operator O grasps front right overhand knot 136 and pull retaining elastic cordage 130 across the top and down the front side of mobile personal computer C until front right overhand knot 136 is below base plate 110. Place retaining elastic cordage 130 into right cordage locking slot 111R and pull retaining elastic cordage 130 to the left until the end of right cordage locking slot 111R is encountered.

FIG. 1 and FIG. 2 of this embodiment of illustrates how to route the power cable P. First operator O threads power cable P under the left side of top base of fabric shell 38 and plug into mobile personal computer C. Operator O then separates external auxiliary pocket conventional loop material 76 from external auxiliary pocket conventional hook material 78 to open the external auxiliary flap 74. Operator O then places the external battery pack B into external auxiliary pocket 72, along with any remaining power cable P which can be become entangled with Operator O or the environment. External auxiliary flap 74 is then sealed against external auxiliary pocket 72 by pressing external auxiliary pocket conventional loop material 76 from external auxiliary pocket conventional hook material 78 together.

This embodiment of hands free case for mobile personal computers 20 is adjustable to any vertical position along the waist/torso. This is accomplished by adjusting the length of waist/torso harness 28 and shoulder harness 30.

Operator O can adjust the length of waist/torso harness 28 by moving waist/torso webbing 156 from one side of waist/torso adjustment slide 154 to the other side. To increase the length of waist/torso harness 28 pull waist/torso webbing 156 through waist/torso adjustment slide 154 from side of waist/torso buckle female 153. During this operation waist/torso webbing 156 will bunch up between the fixed end on waist/torso adjustment slide 154 and waist/torso buckle female 153. To remove this bunched up webbing hold The length of waist/torso harness 28 is decreased by moving waist/torso adjustment slide 154 away from waist/torso buckle female 153. Slack in waist/torso webbing 156 is removed by holding waist/torso adjustment slide 154 and pulling waist/torso buckle female 153 away from waist/torso adjustment slide 154. Since waist/torso harness 28 is adjustable, operator O is provided a custom and comfortable fit while maintaining hands free case for mobile personal computers 20 in the same position.

Operator O can adjust the length of shoulder harness 30 by changing the position of shoulder adjustment slide 164. The length of shoulder harness 30 is increased by moving shoulder adjustment slide 164 away from left shoulder pivoting snap hook 160. Operator O can increase the length of shoulder harness 28 by moving shoulder adjustment slide 164 toward left shoulder pivoting snap hook 160. Since shoulder harness 30 is adjustable, operator O is provide custom and comfortable fit while maintaining hands free case for mobile personal computers 20 at an ideal viewing distance for Operator O.

Figure 8:
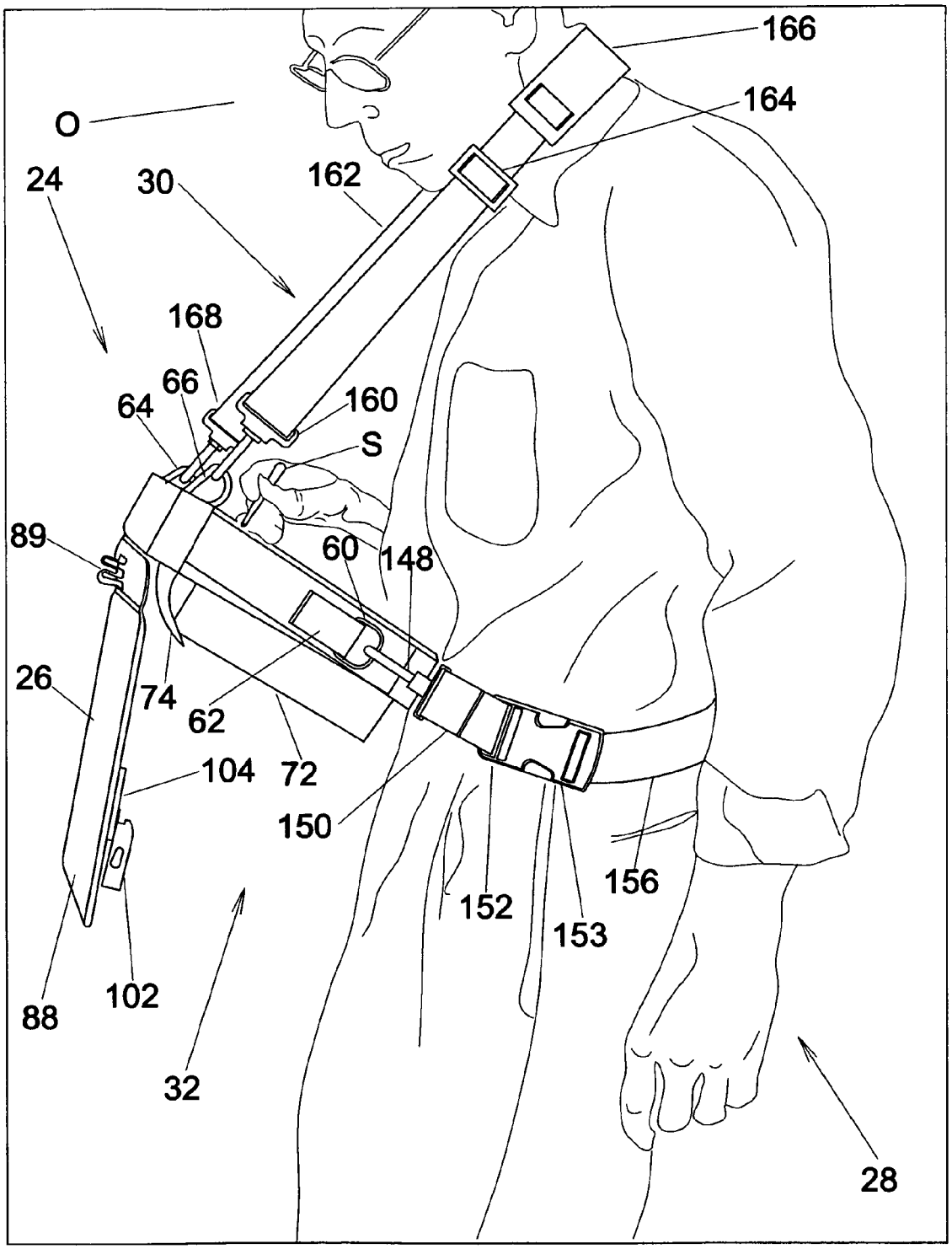
FIG. 8 shows one embodiment in a four (4) point configuration.

FIG. 8 illustrates this embodiment using four (4) point attachment configuration viewed from the left side of operator O in profile. This configuration uses waist/torso harness 28 and shoulder harness 30. Waist/torso harness 28 is adjusted (described previously) to fit around operator O waist so that hands free case for mobile personal computers 20 is kept close to the torso. Waist/torso harness 28 is attached to fabric shell 24 by connecting left waist/torso pivoting snap 148 to left rear conventional D-ring 56 (not shown) and connecting right waist/torso pivoting snap hook 158 to right rear conventional D-ring 60. Shoulder harness 30 is placed around the back of the neck of operator O and shoulder pad 166 is placed on the back of the neck. Shoulder harness 30 is attached to fabric shell 24 by connecting left shoulder pivoting snap hook 160 to left top conventional D-ring 64 and connecting right shoulder pivoting snap hook 168 to right top conventional D-ring 66. Operator O can adjust the angle of fabric shell 24 from a horizontal panel of the by decreasing or increasing the length of shoulder harness 30 as described previously. This configuration provides a stable configuration for the mobile personal computer C and the weight of the mobile personal computer C and hands free case for mobile personal computers 20 are removed from the shoulders of operator O. This configuration is useful if minimum interaction with the touch or pen enabled display is anticipated.

Figure 9:
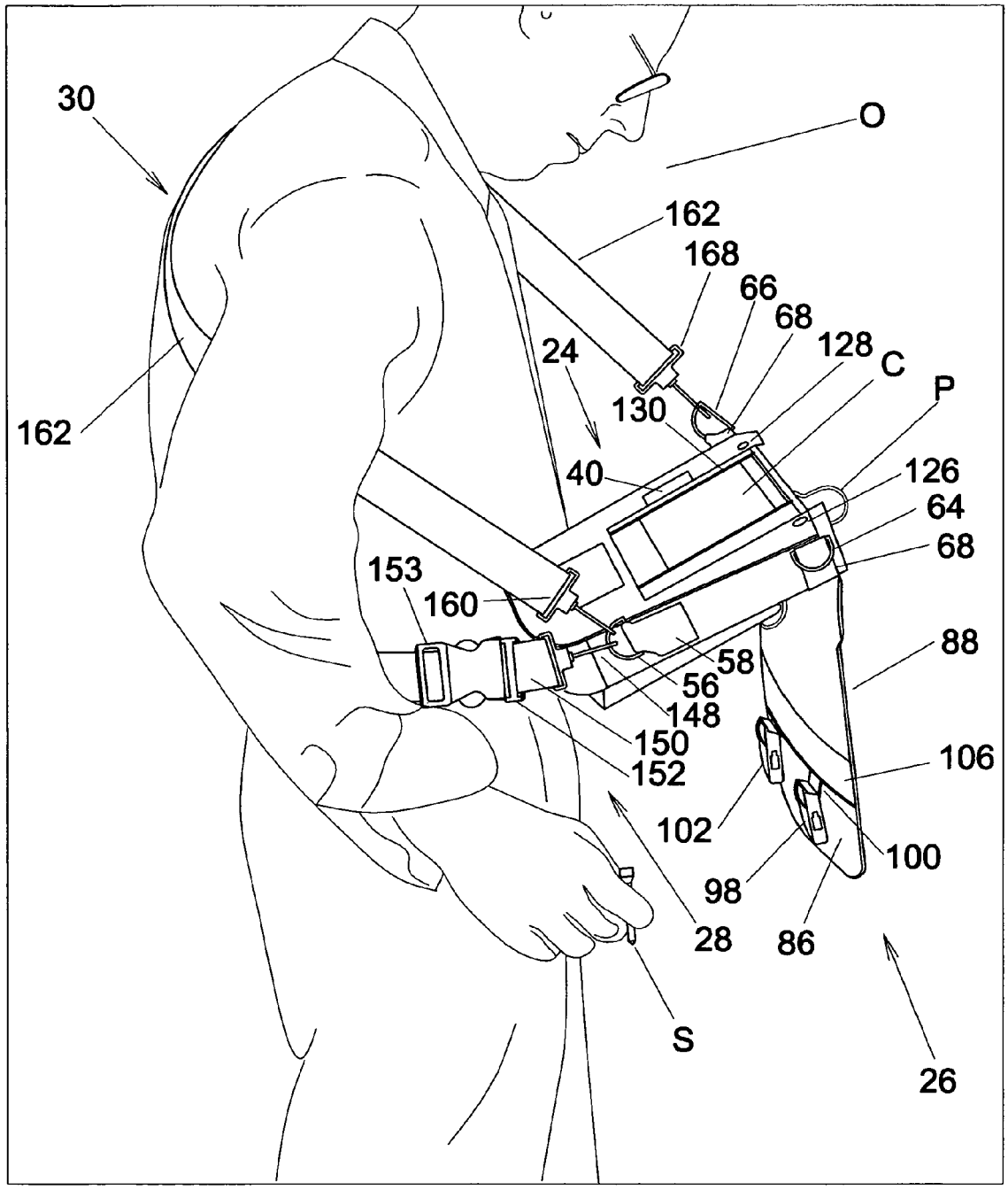
FIG. 9 shows one embodiment in a three (3) point configuration right handed.

FIG. 9 illustrates the embodiment using a three (3) point attachment configuration viewed from the right side of operator O in profile. This configuration uses a waist/torso harness 28 and should harness 30. Waist/torso harness 28 is adjusted (described previously) to fit around operator O waist so that hands free case for mobile personal computers 20 is kept close to the torso. Waist/torso harness 28 is attached to fabric shell 24 by connecting left waist/torso pivoting snap hook 148 to left rear conventional D-ring 56 and connecting right waist/torso pivoting snap hook 158 to right rear conventional D-ring 60 (not shown). Shoulder harness 30 is placed around the over the left shoulder and down the back of Operator O and shoulder pad 166 is positioned on top of the left shoulder of operator O. Shoulder harness 30 is attached to fabric shell 24 by connecting left shoulder pivoting snap hook 160 to left rear conventional D-ring 56 and connecting right shoulder pivoting snap hook 168 to right top conventional D-ring 66. The Operator O can adjust the angle from the horizontal panel of the fabric shell 24 by decreasing or increasing the length of shoulder harness 30 as described above. This configuration provides a stable platform for mobile personal computer C. This configuration provides easy access for a right handed operator, who has to constantly interact with the touch or pen enabled display of mobile personal computer C.

Figure 10:
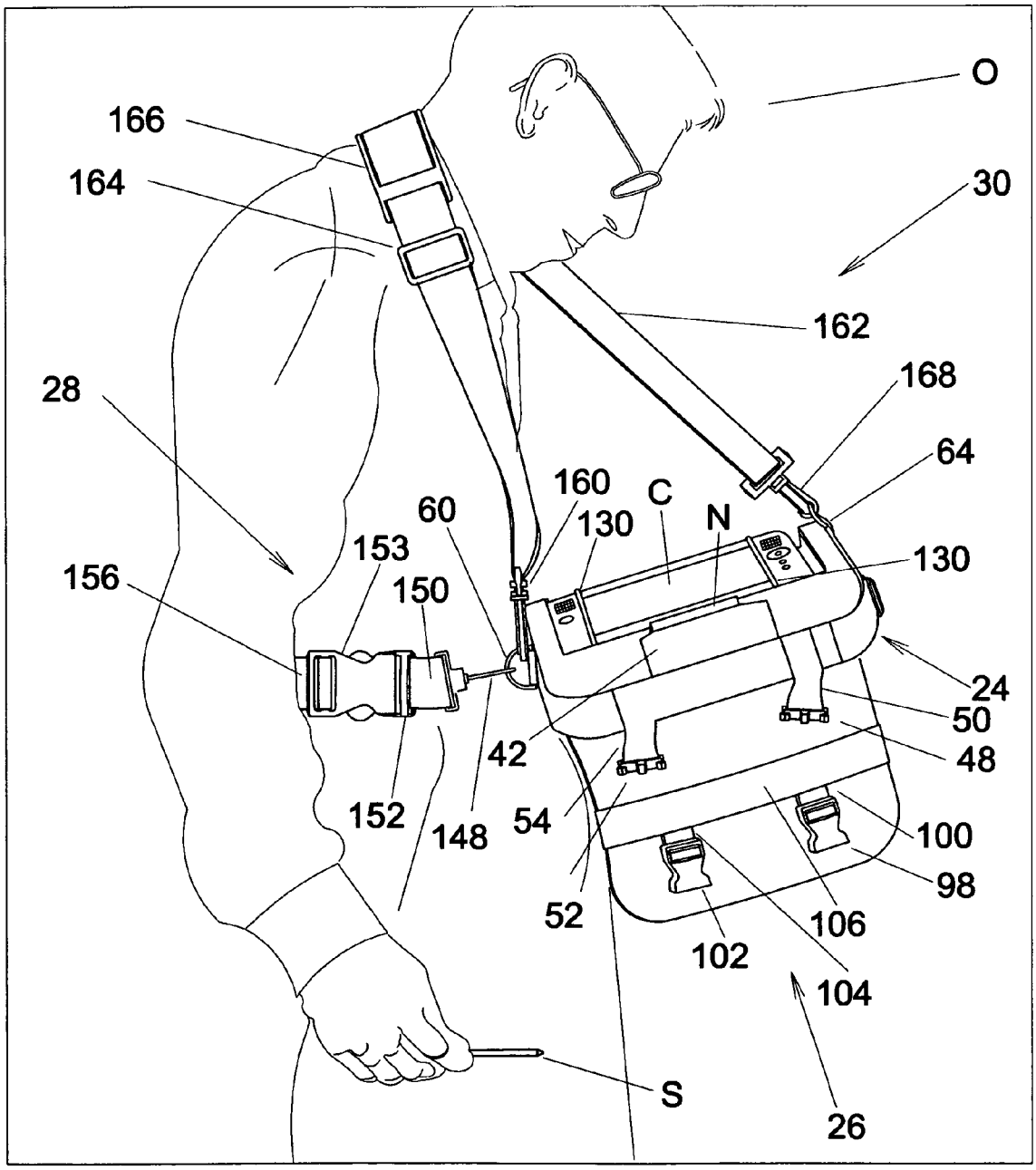
FIG. 10 shows one embodiment in a three (3) point configuration left.

FIG. 10 illustrates the embodiment using a three (3) point attachment configuration viewed from the left side of operator O in profile. This configuration uses a waist/torso harness 28 and should harness 30. Waist/torso harness 28 is adjusted (described previously) to fit around operator O waist so that hands free case for mobile personal computers 20 is kept close to the torso. Waist/torso harness 28 is attached to fabric shell 24 by connecting left waist/torso pivoting snap hook 148 to left rear conventional D-ring 56 (not shown) and connecting right waist/torso pivoting snap hook 158 to right rear conventional D-ring 60. Shoulder harness 30 is placed over the right shoulder and down the back of operator O. Shoulder pad 166 is positioned on top of the right shoulder of operator O. Shoulder harness 30 is attached to fabric shell 24 by connecting left shoulder pivoting snap hook 160 to left top conventional D-ring 64 and connecting right shoulder pivoting snap hook 168 to right rear conventional D-ring 60 (not shown). The Operator O can adjust the angle from the horizontal panel of the fabric shell 24 by decreasing or increasing the length of shoulder harness 30 as described above. This configuration provides a stable platform for mobile personal computer C. This configuration provides easy access for a left-handed operator, who has to constantly interact with the touch or pen enabled display of mobile personal computer C.

Figure 11:
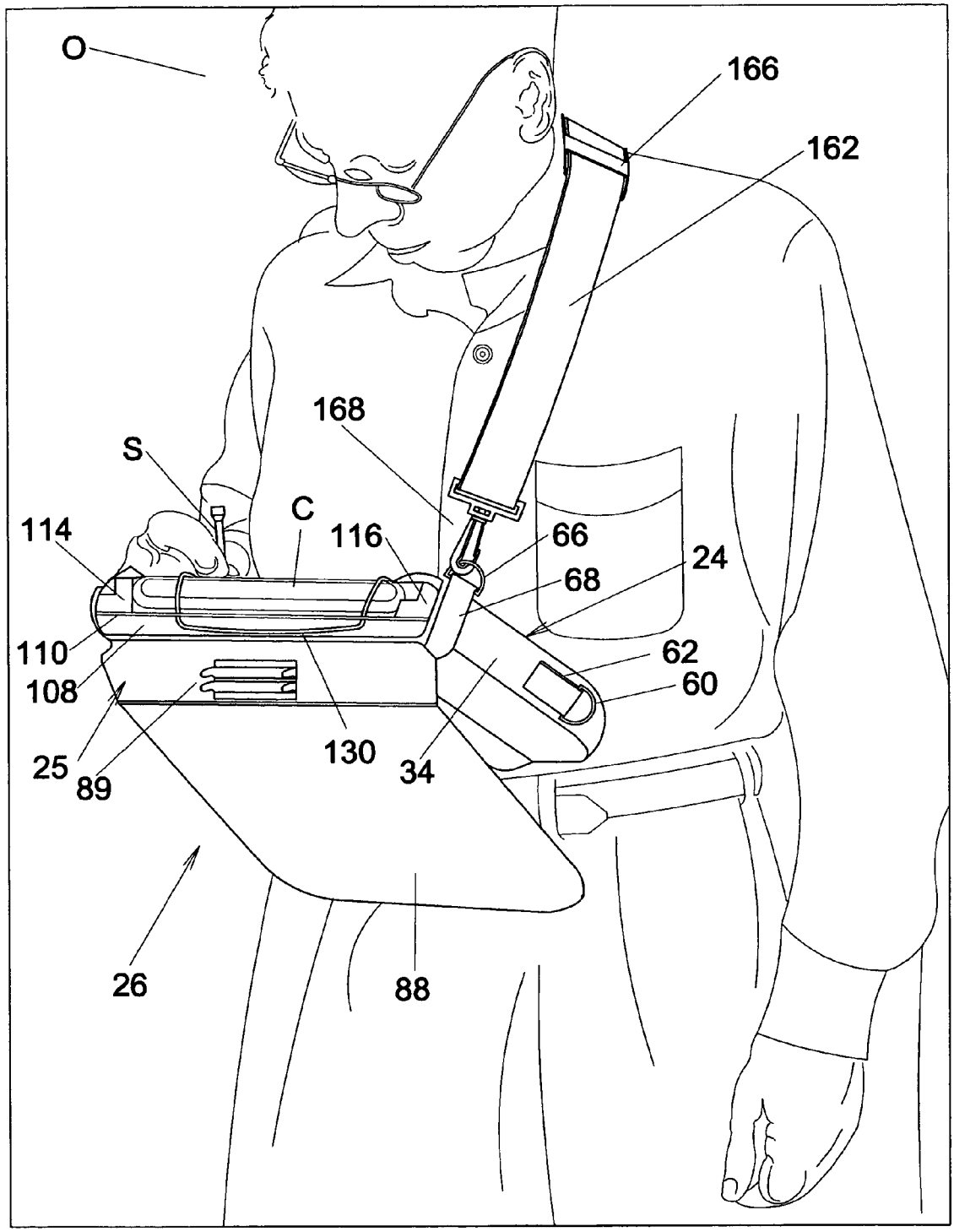
FIG. 11 shows one embodiment in a two (2) point configuration right handed.

FIG. 11 illustrates the embodiment using a two (2) point attachment configuration viewed from the front and left side of operator O. The configuration only uses should harness 30. Shoulder harness 30 is placed over the top of left shoulder and down the back of Operator O. Shoulder pad 166 is positioned on top of left shoulder of operator O. Shoulder harness 30 is attached to fabric shell 24 by connecting left shoulder pivoting snap hook 160 (not shown) to left rear conventional D-ring 56 (not shown) and connecting right shoulder pivoting snap hook 168 to right top conventional D-ring 66. The operator O can adjust the angle from the horizontal panel of the fabric shell 24 by decreasing or increasing the length of shoulder harness 30 as described previously. This configuration allows for mobile personal computer C and fabric shell 24 to rotate quickly against the torso. This configuration provides easy access for a right-handed operator, who has to constantly interact with the touch or pen enabled display of mobile personal computer C.

Figure 12:
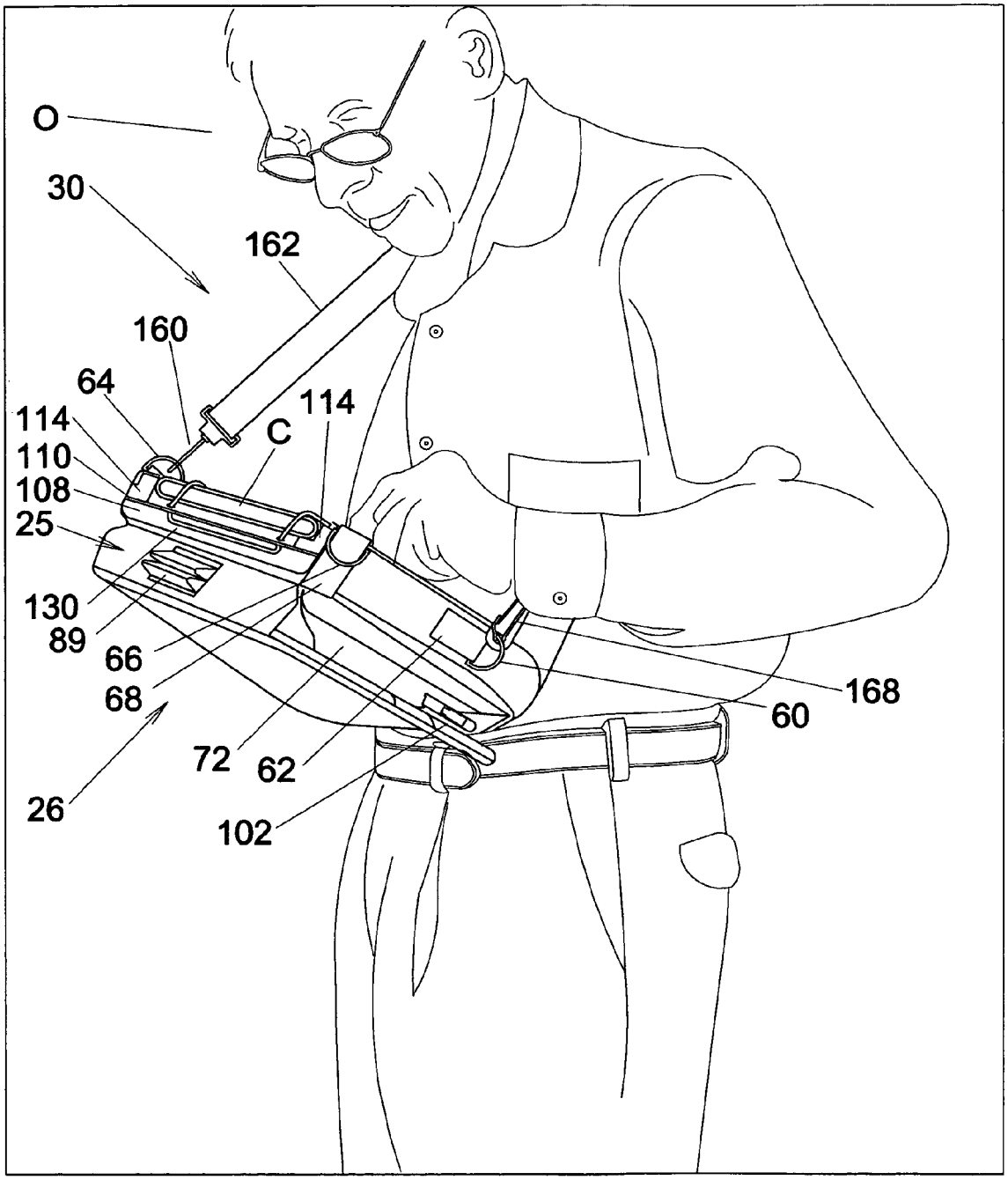
FIG. 12 shows one embodiment in a two (2) point configuration left.

FIG. 12 illustrates the embodiment using a two (2) point attachment configuration viewed from the front and left side of operator O. The configuration only uses should harness 30. Shoulder harness 30 is placed over the top of right shoulder and down the back of Operator O. Shoulder pad 166 (not shown) is positioned on top of right shoulder of operator O. Shoulder harness 30 is attached to fabric shell 24 by connecting left shoulder pivoting snap hook 160 to left top conventional D-ring 64. Connecting right shoulder pivoting snap hook 168 to right rear conventional D-ring 60. The operator O can adjust the angle from the horizontal panel of the fabric shell 24 by decreasing or increasing the length of shoulder harness 30 as described previously. This configuration allows for mobile personal computer C and fabric shell 24 to rotate quickly against the torso. This configuration provides easy access for a left-handed operator, who has to constantly interact with the touch or pen enabled display of mobile personal computer C.

FIG. 12 shows a configuration of articulated flap 26 being secured under the fabric shell 24. Operator O extends left male buckle webbing 50 to its full length by pulling left buckle male 48. Operator O extends right male buckle webbing 54 to its full length by pulling right buckle male 52. Operator O then insert left buckle male 48 into and left buckle female 98. Operator O then insert right buckle male 52 into right buckle female 102.

FIG. 13 illustrates the embodiment in a two (2) point transport configuration viewed from the right side of operator O. The configuration only uses should harness 30. Shoulder harness 30 is placed over either shoulder of operator O and shoulder pad 166 is positioned on top of the shoulder of operator O. Shoulder harness 30 is attached to fabric shell 24 by connecting left shoulder pivoting snap hook 160 to left top conventional D-ring 64 and connecting right shoulder pivoting snap hook 168 to right top conventional D-ring 66. Operator O can adjust the vertical position of the hands free case for mobile personal computers 20 by decreasing or increasing the length of shoulder harness 30 as previously described.

Articulated flap 26 is closed over the screen of mobile personal computer C. To lock articulated flap 26 to fabric shell 24 insert left conventional male buckle 48 into left conventional female buckle 98 and pull the free end of left male buckle webbing 50 until all slack is removed. Then insert right conventional male buckle 52 into right conventional female buckle 102 and pull the free end of right male buckle webbing 54 until all slack is removed. With articulated flap 26 fastened to fabric shell 24 screen of mobile personal computer C is protected during transport.

Figure 14:
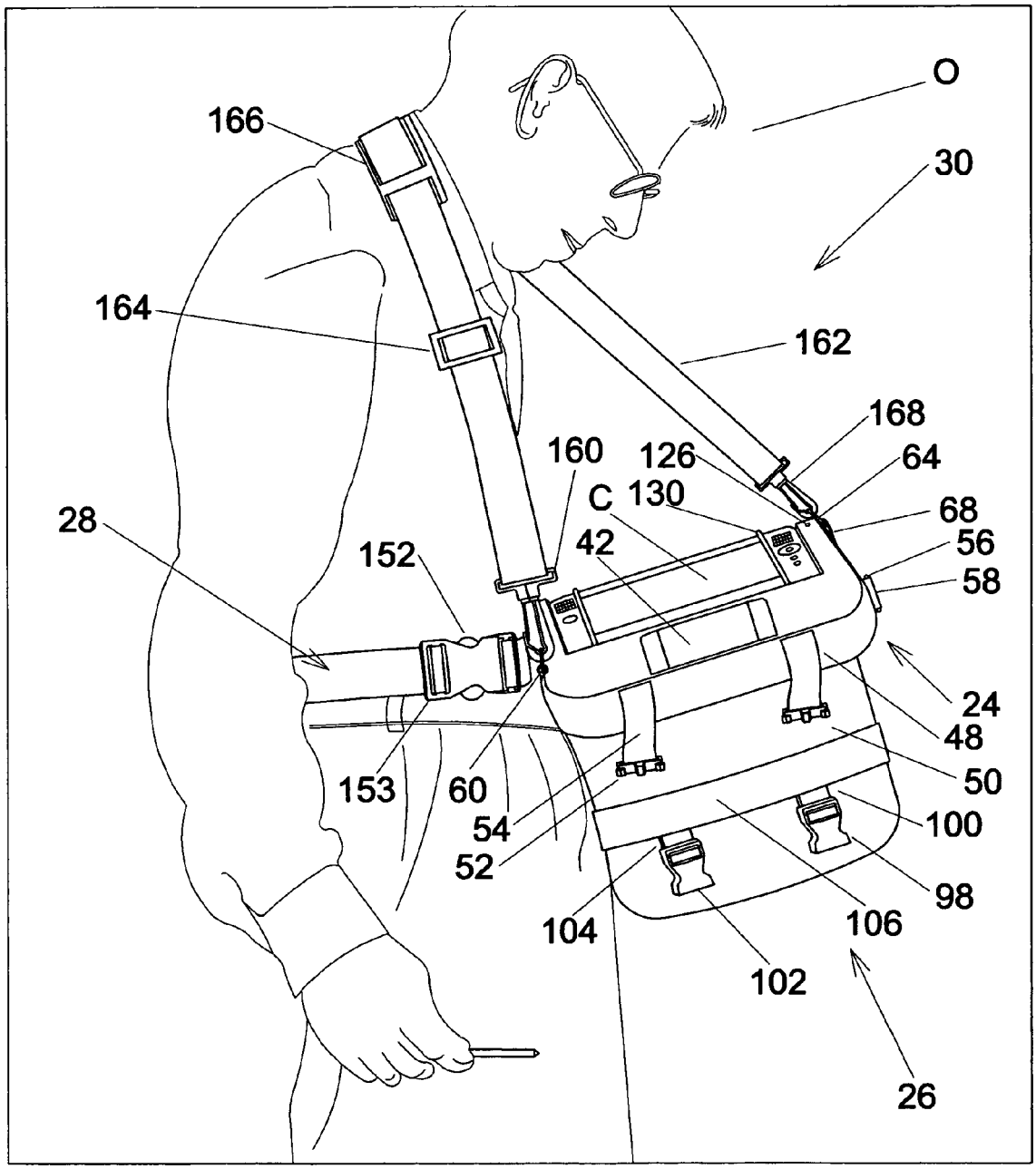
FIG. 14 shows one embodiment in three (3) point right handed configuration for portrait mode.

FIG. 14 illustrates the embodiment using a three (3) point attachment configuration viewed from the front and to the right of operator O. Operator O has changed the page orientation of the screen for mobile personal computer C to portrait mode by changing settings in the operating system. This configuration uses a waist/torso harness 28 and a should harness 30. Waist/torso harness 28 is adjusted (described previously) to fit around operator O waist so that hands free case for mobile personal computers 20 is kept close to the torso. Waist/torso harness 28 is attached to fabric shell 24 by connecting left waist/torso pivoting snap hook 148 to left rear conventional D-ring 60 and connecting right waist/torso pivoting snap hook 158 (not shown) to right rear conventional D-ring 56 (not shown). Should harness 30 is placed over the left shoulder and down the back of operator O and shoulder pad 166 is positioned on top of the Operator O left shoulder. Should harness 30 is attached to fabric shell 24 by connecting left shoulder pivoting snap hook 160 to left rear conventional D-ring 60 and connecting right shoulder pivoting snap hook 168 to left top conventional D-ring 64. Operator O can adjust the angle from the horizontal panel of the fabric shell 24 by decreasing or increasing the length of should harness 30 as described previously. This configuration provides a stable plate for mobile personal computer C. This configuration provides easy access for a right handed operator, who has to constantly interact with the touch or pen enabled display of mobile personal computer C and allows the page orientation of the screen to be set in portrait mode.

Figure 15:
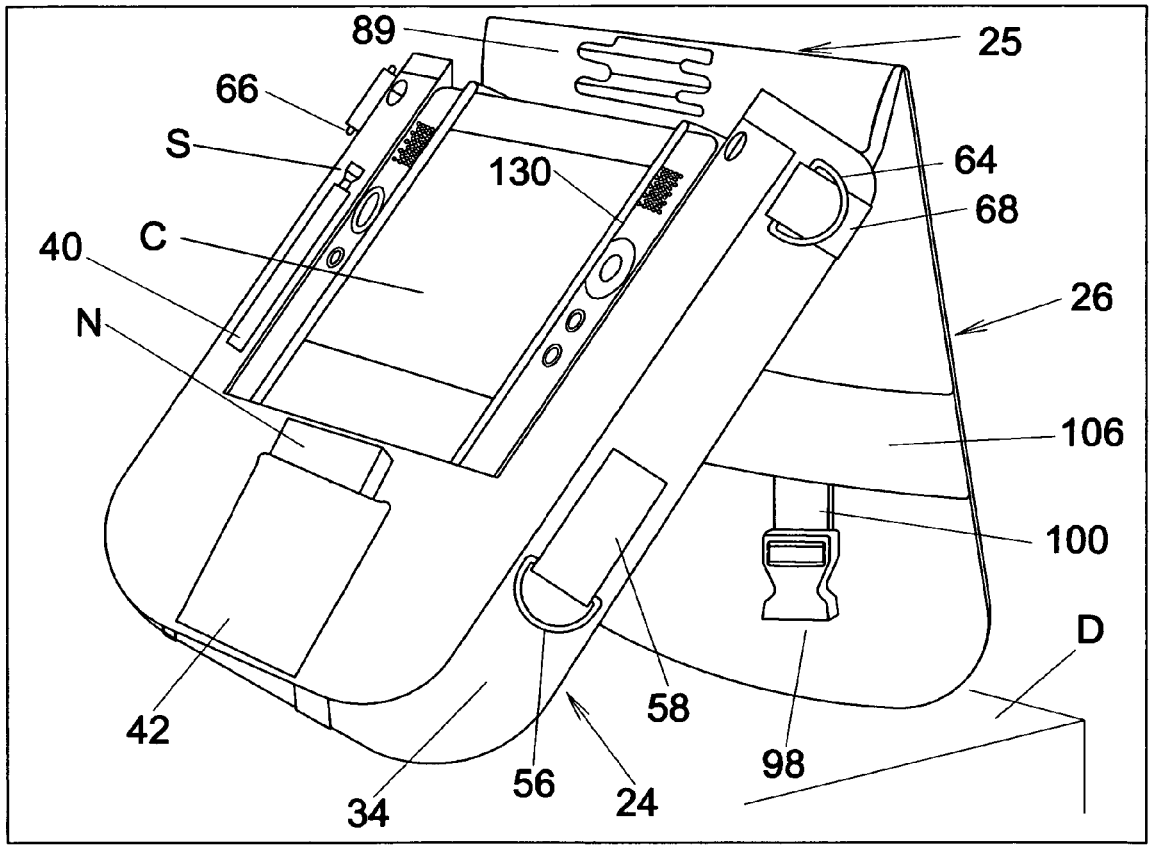
FIG. 15 shows one embodiment of a case in vertical free standing mode.

FIG. 15 illustrates the embodiment in a stand alone upright configuration on the top of desk D. The fabric shell 24 to stood on end on top of desk D with the mobile personal computer C at the top and fabric shell 24 tilted slightly backward. Top articulated flag 25 is positioned vertical above fabric shell 24. Articulated flap 26 is then folded backwards behind top articulated flag 25 and angled slightly away from fabric shell 24. The bottom edge of the articulated flap 26 is then rested on top of desk D.

Description

Alternate Embodiment—FIGS. 16, 16A

FIG. 16 illustrates an embodiment of the exterior auxiliary pocket 32, having multiple compartments in plan view.

In this embodiment external auxiliary pocket 72 and external auxiliary flap 74 are assembled and positioned as described previously.

The width of left external auxiliary pocket 170L and right external auxiliary pocket 170R are equal to ½ of the remaining width of bottom base of fabric shell 36 not covered by external auxiliary pocket 72 minus approximately two seam allowances.

The width of left external auxiliary pocket 170L and right external auxiliary pocket 170R are equal to distance from the top of external auxiliary pocket 72 to the start of the curve of bottom base of fabric shell 36.

The left external auxiliary pocket conventional loop material 174L length is ⅔ the finished width of left external auxiliary pocket 170L. Left external auxiliary pocket conventional loop material 174L (not shown in FIG. 16) is joined below the top seam and on the exterior of left external auxiliary pocket 170L.

The left external auxiliary pocket conventional hook material 176L (not shown in FIG. 16) length is equal to the length of left external auxiliary pocket conventional loop material 174L. Left external auxiliary pocket conventional hook material 176L is joined below the top seam and on the interior of left external auxiliary flap 172L.

Left external auxiliary pocket 170L front seam is folded under and joined to the interior of left external auxiliary pocket 170L. The left, rear and right seams are joined to the interior of left external auxiliary pocket 170L and then are turned up perpendicular to left external auxiliary pocket 170L. The left rear vertical seams of left external auxiliary pocket 170L is joined together to form the depth of the pocket. The right rear vertical seams of left eternal auxiliary pocket 170L is joined together to form the depth of the pocket.

Left horizontal seam of left external auxiliary pocket 170L is positioned parallel to left side of bottom base of fabric shell 36 next to vertical webbing of fabric shell 34. The top of left external auxiliary pocket 170L is aligned with the top of external auxiliary pocket 72. Left, rear and right seams of left external auxiliary pocket 170L are joined to bottom base of fabric shell 36.

The left external auxiliary flap 172L left, rear and left seams are joined to the interior of left external auxiliary flap 172L. The left external auxiliary flap conventional hook material 176L is centered along the rear edge of left external auxiliary flap 172L and joined to the interior of left external auxiliary flap 172L. Left external auxiliary flap 172L is centered along width of bottom base of fabric shell 36 and will be under the top D-Lings attachment webbing 68. Left external auxiliary flap 172L top edge is joined to bottom base of fabric shell 36 to length which is equal to half the width of D-Lings attachment webbing 68.

The right external auxiliary pocket conventional loop material 174R (not shown in FIG. 16) length is ⅔ the finished width of right external auxiliary pocket 170R. Right external auxiliary pocket conventional loop material 174R is joined below the top seam and on the exterior of right external auxiliary pocket 170R.

The right external auxiliary pocket conventional hook material 176R (not shown in FIG. 16) length is equal to the length of right external auxiliary pocket conventional loop material 174R. Right external auxiliary pocket conventional hook material 176R is joined below the top seam and on the interior of right external auxiliary flap 172R.

Right external auxiliary pocket 170R front seam is folded under and joined to the interior of right external auxiliary pocket 170R. The right, rear and right seams are joined to the interior of right external auxiliary pocket 170R and then are turned up perpendicular to right external auxiliary pocket 170R. The right rear vertical seams of right external auxiliary pocket 170R is joined together to form the depth of the pocket. The right rear vertical seams of right eternal auxiliary pocket 170R is joined together to form the depth of the pocket.

Right horizontal seam of right external auxiliary pocket 170R is positioned parallel to right side of bottom base of fabric shell 36 next to vertical webbing of fabric shell 34. The top of right external auxiliary pocket 170R is aligned with the top of external auxiliary pocket 72. Right, rear and right seams of right external auxiliary pocket 170R are joined to bottom base of fabric shell 36.

The right external auxiliary flap 172R right, rear and right seams are joined to the interior of right external auxiliary flap 172R. The external auxiliary flap conventional hook material 78 is centered along the rear edge of right external auxiliary flap 172R and joined to the interior of right external auxiliary flap 172R. Right external auxiliary flap 172R is centered along width of bottom base of fabric shell 36 and will be under the top D-rings attachment webbing 68. Right external auxiliary flap 172R top edge is joined to bottom base of fabric shell 36 to length which is equal to half the width of D-rings attachment webbing 68.

FIG. 16A illustrates an embodiment of the exterior auxiliary pocket 32 multiple compartments along section 16A-16A. This depth of the all three compartments are equal in this embodiment.

Operation

Alternate Embodiment—FIG. 16

FIG. 16 illustrates an embodiment of exterior auxiliary pocket 32 with multiple compartments. The only operation is opening and closing of the three flaps as required by operator O in store or remove items from the various compartments. The operation of opening and closing the flaps have been described previously.

Conclusion, Ramifications, and Scope

Accordingly the reader will see that, according to one embodiment of the hands free case for mobile computers, I have provided a case that is lightweight, simple to use and can accommodate different mobile personal computers. When the case is deployed, the hands of the operator are free to facilitate movement, assist in maintaining balance while not being required to hold the mobile personal computer and peripheral devices can be easily operated. The case provides the operator the ability to change the screen orientation without taking the device out of the protective case.

While the above description contains many specifications, these should not be construed as limitation on the scope of any embodiment, but as exemplification of the presently preferred embodiments thereof. Many other ramifications and variation are provided within the teachings of the various embodiments. For example:

External auxiliary pocket conventional loop material 76 and external auxiliary pocket conventional hook material 78 can be replaced with a mechanical zipper, buttons, snaps or buckles.

Stylus holder 40 could be removed completely from an embodiment. The location of the stylus holder 40 could also be changed. An example would from the right side of the case to the left side. Any of materials could be used to construct stylus holder 40.

Auxiliary note pad pocket with flexible opening 42 could be removed completely.

Auxiliary note pad pocket with flexible opening 42 could be replaced with a one or more stripes of conventional elastic material or mesh fabric. The direction of the opening of auxiliary note pad pocket with flexible opening 42 could be rotated 90 degrees to the left or right to allow peripheral devices to be carried and accessed easily. The opposite side from the open end of the pocket could also be opened to allow peripheral devices to be slipped all the way through.

Articulated flap 26 can be fastened to the fabric shell 24 with hook and loop, snaps or a mechanical zipper (either metal or plastic) so it can be removed during operations.

The various buckles can be replaced with hook and loop, buttons, snaps and mechanical zipper (either metal or plastic).

Left cordage locking slot 111L and right cordage locking slot 111R can be a different shape. One example would be an open ended slot going from front to back of base plate 110. Another example would be a hole located at the closed ends of left cordage locking slot 111L and right cordage locking slot 111R. This is not be limiting in shape or configuration that may be applied to any embodiment.

Base plate 110, left conventional female-female standoff 118 and right conventional female-female standoff 120 can be replaced mold plastic base plate. This would remove the left conventional base plate screw 122, right conventional base plate screw 124, left conventional female-female standoff 118 and right conventional female-female standoff 120 from the embodiment. The molded base plate would reduce the number of steps to manufacture and complexity of the assembly.

The diagonal corners of base plate 110 can be changed to mirror the corner treatment of base cushion 108 and top rear cushion 112.

Base cushion 108, top rear cushion 112, left cushion rail 114 and right cushion rail 116 can be produced using a over molding process around base plate 110.

Top rear cushion 112, left cushion rail 114 and right cushion rail 116 can be produced from a single piece of foam either molded or cut using a steel rule die or and other method of forming and shaping.

The rear rounder corners of fabric case 24 and base cushion 108 and rear top cushion 112 can be changed to squared, elliptical or any other shape that maybe desired or is beneficial to the embodiment.

Left waist/torso pivoting snap hook 148, right waist/torso pivoting snap hook 158, left shoulder pivoting snap hook 160 and right shoulder pivoting snap hook 168 can be replaced with just non-pivoting snap hooks. The above listed pivoting snap hooks could be removed form an embodiment and the associated webbing joined directly to D-rings. This would limit the versatility of the case.

Overhand knot 134 and overhand knot 136 maybe removed from an embodiment as long as the retaining elastic cordage 130 is continuous from overhand knot 132 to overhand knot 138.

Overhand knot 132, overhand knot 134 overhand knot 136 and overhand knot 138 can be replaced with some type of mechanical clapping device for cordage. All or some of the overhand knots can be replaced with a clapping device.

Optically clear flexible sheet 70 can be stitched or welded to the under side of top fabric base 38. Optically clear flexible sheet 70 can be fastened to the under side or top of top fabric base 38 using hook and loop, zippers, snaps or other type of mechanical fasteners. Optically clear flexible sheet 70 may be totally removed from an embodiment.

An embodiment would include an additional shoulder harness 30 can be used to create a six (6) point connection. Additional shoulder harness 30 is attached to fabric shell 24 by connecting additional left shoulder pivoting snap hook 160 to left rear conventional D-ring 56. Loop additional shoulder harness 28 over the right shoulder of operator O. Then position additional shoulder pad 166 on top of the right shoulder. Connect additional right shoulder pivoting snap hook 168 to right top conventional D-ring 66. Shoulder harness 30 is attached to fabric shell 24 by connecting left shoulder pivoting snap hook 160 to left top conventional D-ring 64. Loop shoulder harness 30 over the left shoulder and around the back of operator O. Then position shoulder pad 166 on top of the left shoulder. Connect right shoulder pivoting snap hook 168 to right rear conventional D-ring 54.Waist/torso harness 28 is attached to fabric shell 24 by connecting left waist/torso pivoting snap hook 148 to left rear conventional D-ring 56 and connecting right waist/torso pivoting snap hook 158 to right rear conventional D-ring 60. This configuration would form a diagonal cross the back of Operator O, thus relieving strain on the neck of operator O.

An embodiment would use waist/torso harness 28 as a shoulder strap which would create a four (4) point connection configuration. Waist/torso harness 28 is attached to fabric shell 24 by connecting left waist/torso pivoting snap 148 to left rear conventional D-ring 56. Loop waist/torso harness 28 over the right shoulder of operator O and connect right waist/torso pivoting snap hook 158 to right top conventional D-ring 66. Shoulder harness 30 is attached to fabric shell 24 by connecting left shoulder pivoting snap hook 160 to left top conventional D-ring 64. Loop shoulder harness 30 over the left shoulder and around the back of operator O. Then position shoulder pad 166 on top of the left shoulder. Connect right shoulder pivoting snap hook 168 to right rear conventional D-ring 54. This configuration would form a diagonal cross the back of Operator O, thus relieving strain on the neck of operator O.

An embodiment would use waist/torso harness 28 in a two (2) point configuration. Articulated flap 26 is folded behind fabric case 24. Waist/torso harness 28 is attached to fabric shell 24 by connecting left waist/torso pivoting snap 148 to left top conventional D-ring 64. Loop waist/torso harness 28 around the opposite side of the operator from the side that fabric shell 24 is positioned. Connect right waist/torso pivoting snap 158 to right top conventional D-ring 66. This embodiment could use other embodiments of waist/torso harness 28. This embodiment allows the mobile personal computer C placed adjacent to the leg of the operator and low profile.

The left rear conventional D-ring 56, left rear D-ring attachment webbing 58, right rear conventional D-ring 60, right rear D-ring attachment webbing 62 can be replace with pivoting D-rings and tabs.

The D-rings in any embodiment can be replaced with other geometry continuous rings. An example would be circular, elliptical, square or rectangular, but not limited to these geometries.

The left top conventional D-ring 64 and right top conventional D-ring 66 can be replace with pivoting D-rings and tabs.

Thus the scope of the invention should be determined by the appended claims and their legal equivalents, and not by the examples given.

The invention claimed is:

1. A mobile personal computer carrying case comprising:

a. a case structure comprising:

i. a flexible rectangular box with filleted corners having an interior volume, a continuous wall on two sides and rear side, bottom panel portion, interior top panel portion with a foramen surrounding said interior volume, lower and upper edges of said continuous wall forming with bottom panel portion and top panel portion an exterior of the case structure;

ii. a articulated cover releasably joinable to flexible rectangular box with filleted corners, a front wall, a top cover portion surrounding said interior volume, lower edge of said front wall forming with front edge of said bottom panel portion, upper edge of front wall forming with rear edge of top cover portion an exterior of the case structure;

iii. an internal frame structure comprising:

(1) a bottom cushion congruent with the flexible rectangular box with filleted corners;

(2) a rigid rhomboid plate having overall dimension equal to flexible rectangular box with filleted corners;

(3) a top cushion congruent with the flexible rectangular box with filleted corners with a cavity large enough to fit a mobile personal computer and an offset distance equal to distance from the rear of the continuous wall and the rear edge of the foramen in the top plane portion;

iv. means for releasably attaching the internal frame structure to the flexible rectangular box with filleted corners;

v. means for releasably attaching the mobile personal computer to the rigid rhomboid plate;

b. a harness comprising;

i. a first strap having two ends and an adjustable slide to alter the length of said strap, attached to the first end of the front end of the continuous wall at an attachment point and attached at the second end to the second rear attachment point on continuous wall;

ii. means for releasably attaching to the flexible rectangular box with filleted corners;

iii. a second strap having two ends and an adjustable slide to alter the length of said strap, attached to the first rear attachment point on the continuous wall and attached at the second end to the second rear attachment point on continuous wall;

iv. means for releasably attaching to the flexible rectangular box with filleted corners and;

v. whereby the first strap runs along the vertical axis of the body of the second strap runs along the horizontal axis of the body so that the case is held in a generally horizontal plane in front of and against the torso of the wearer;

c. a opposing tension restraint lock mechanism comprising:

i. a elastic tension restraint having two ends, first end attached to a first hole in rear said rigid rhomboid plate, second end attached to a second hole in hole in rear said rigid rhomboid plate;

ii. a first opened "L" shaped slot in formed in front and to one side of the rigid rhomboid plate, with longest leg set parallel to front of said rigid rhomboid plate and in a direction toward middle of said rigid rhomboid plate;

iii. a second opened "L" shaped slot in formed in front and to opposite side of said rigid rhomboid plate, with longest leg set parallel to front of said rigid rhomboid plate and in a direction toward middle of said rigid plate;

iv. whereby the elastic tension restraint is looped over the mobile personal computer and threaded into the first opened "L" shape slot, pulled to the second opened "L" shape slot and threaded through and over the mobile personal computer.

2. The mobile personal computer carrying case of claim 1 wherein said flexible rectangular box with filleted corners can be vertically positioned by wearer;

a. a first strap of said harness length is adjusted by slide to position said flexible rectangular box with filleted corners along the vertical axis of the body;

b. a second strap of said harness length is adjusted by slide to hold the horizontal plane of said flexible rectangular box with filleted corners position along the vertical axis of the body;

c. whereby the first strap length and the second strap length being adjusted allows for optimal viewing distance of mobile personal computer screen.

3. The mobile personal computer carrying case of claim 1 wherein said flexible rectangular box with filleted corners can be angled in the vertical panel by wearer;

a. a first strap of said harness length is adjusted to rotated around the horizontal rear axis of said flexible rectangular box with filleted corners;

b. a second strap of said harness is held at the desire vertical position along the vertical axis of the body;

c. whereby the first strap length being adjusted allows said flexible rectangular box with filleted corners to be rotated for control of glare on mobile personal computer screen.

4. The mobile personal computer carrying case of claim 1 wherein said flexible rectangular box with filleted corners further comprising of one or more accessories pocket formed to the exterior of said bottom panel portion of the case structure.

* * * * *